US007242872B2

(12) United States Patent
Okamoto et al.

(10) Patent No.: US 7,242,872 B2
(45) Date of Patent: Jul. 10, 2007

(54) IMAGE FORMING APPARATUS WITH CHANGEOVER CONTROL FOR DEVELOPMENT CARTRIDGES

(75) Inventors: Katsumi Okamoto, Nagano (JP); Keiichi Taguchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 94 days.

(21) Appl. No.: 11/077,510

(22) Filed: Mar. 8, 2005

(65) Prior Publication Data

US 2005/0201764 A1 Sep. 15, 2005

(30) Foreign Application Priority Data

Mar. 9, 2004 (JP) ..... P2004-066150
Mar. 9, 2004 (JP) ..... P2004-066151
Mar. 9, 2004 (JP) ..... P2004-066152
Mar. 9, 2004 (JP) ..... P2004-066153

(51) Int. Cl.
*G03G 15/00* (2006.01)

(52) U.S. Cl. ..... 399/12; 399/13; 399/27; 399/227

(58) Field of Classification Search ..... 399/12, 399/13, 27, 28, 53, 119, 222, 223, 226, 227, 399/228
See application file for complete search history.

(56) References Cited

U.S. PATENT DOCUMENTS 4,579,443 A * 4/1986 Abuyama et al. ..... 399/28
4,792,825 A * 12/1988 Saito et al. ..... 399/227
4,931,837 A * 6/1990 Abuyama et al. ..... 399/13
4,941,018 A * 7/1990 Kasamura et al. ..... 399/226
7,065,304 B2 * 6/2006 Taguchi ..... 399/12

FOREIGN PATENT DOCUMENTS

| | | |
|---|---|---|
| EP | 1 081 561 | 3/2001 |
| EP | 1 146 399 | 10/2001 |
| EP | 1 384 591 | 1/2004 |
| JP | 05-061342 | 3/1993 |
| JP | 10-301358 | 11/1998 |
| JP | 2002-351190 | 12/2002 |
| JP | 2003-050494 | 2/2003 |
| JP | 2003-098823 | 4/2003 |
| JP | 2003-215886 | 7/2003 |
| JP | 2003-316106 | 11/2003 |

* cited by examiner

*Primary Examiner*—Sandra L. Brase
(74) *Attorney, Agent, or Firm*—Hogan & Hartson LLP

(57) ABSTRACT

An image forming apparatus includes a carrier on which an electrostatic latent image is formed, a plurality of development cartridges which develop the electrostatic latent image with toner to form a toner image to be transferred to a recording sheet, and a changeover unit which changes the development cartridges so that any one of the development cartridges is moved so as to face a surface of the carrier for development. At least two of the development cartridges contain the same color toners. The changeover unit repeatedly changes the development cartridges before an expiration of lifetime of one of the development cartridges which is positioned so as to face the carrier for the development.

12 Claims, 21 Drawing Sheets

IMAGE FORMING APPARATUS WITH CHANGEOVER CONTROL FOR DEVELOPMENT CARTRIDGES

BACKGROUND OF THE INVENTION

The present invention relates to an image forming apparatus, and more specifically, to an image forming apparatus in which a plurality of development cartridges containing the same color toners are mounted, and capable of reducing bad effects as much as possible, the bad effects being occurred by operating a development cartridge to be operated excluding and not operating the remaining development cartridges.

Also, the present invention relates to an image forming apparatus, and more specifically, to an image forming apparatus which can smoothly continue an image forming operation when a plurality of development cartridges containing the same color toners are mounted to form a monochromatic image.

Conventionally, an image forming apparatus, using an electro-photographic recording method, in which an electrostatic latent image is exposed and formed on the surface of a carrier made of a photoreceptor is known. In the image forming apparatus, a toner image on the surface of the carrier, which is carried by developing the electrostatic latent image with toner, is transferred to a recording medium such as a recording sheet to thereby form an image. The electrostatic latent image is developed with toner by rotating a developing roller facing the surface of the carrier, and transferring and sticking toner on the surface of the developing roller to the carrier. The developing roller is supplied with toner by rotating a supply roller rotating within a toner containing space in pressure contact with the developing roller.

In the image forming apparatus employing such an electro-photographic recording method, a development cartridge in which a developing roller and a supply roller are arranged in a container containing toner is attached or removed to replenish toner. As the image forming apparatus, an image forming apparatus having a construction in which a plurality of development cartridges is mountably configured, and the same color toners are contained within the development cartridges has been suggested. In this case, a development cartridge which sticks toner to the surface of the carrier is changed over at a timing of runout of toner, so that the number of replenishment of toner can be reduced to continue image forming (for example, see JP-A-2002-351190 and JP-A-2003-316106).

The image forming apparatuses disclosed in JP-A-2002-351190 and JP-A-2003-316106, are rotary type image forming apparatuses in which a plurality of development cartridges are accommodated and mounted around a rotating shaft of a rotary unit. However, there is also a tandem type image forming apparatus in which a plurality of development cartridges or carries is juxtaposed linearly.

As thus described, in the image forming apparatuses to which a plurality of development cartridges can be mounted, as disclosed in JP-A-2002-351190 and JP-A-2003-316106, a development cartridge facing the carrier is changed over to the next development cartridge after runout of toner in the facing development cartridge, thereby image forming does not need a work of replenishing toner. In addition, JP-A-2002-351190 discloses a changing over of a development cartridges before a toner around the supply roller runs out. This construction permits eliminating the timing for determining whether or not toner runs out completely and development becomes disabled, and realizing more continuous image forming.

Further, as such image forming apparatuses, an image forming apparatus in which only a developing roller and a supply roller of a development cartridge which faces the surface of a carrier and develops an electrostatic latent image is coupled with a driving source to transmit a rotational driving force is known.

However, in this type of image forming apparatus, since the remaining development cartridges excluding a development cartridge which performs image forming processing remains stationary, a state in which the developing roller and the supply roller are pressure-contacted with each other at the same place lasts. Therefore, when a development cartridge is changed over to perform new image forming, the effects may appear. Specifically, when a developing roller stops for a prolonged period of time, a trace which has been pressure-contacted with a supply roller may remain on the surface of the developing roller. In this case, when toner is stuck onto the surface of the carrier, a place corresponding to the position of pressure contact and other places does not match. As a result, for a while after starting to form an image, a striped trace (so called, leaving banding) for every one rotation of the developing roller may appear in a toner image, which may deteriorate the quality of an image to be formed.

Although a case in which a trace of pressure contact with the supply roller appears in a toner image as so-called leaving banding during a period for which the developing roller stops which deteriorates the image quality is described as an example in the present specification, the present invention is not limited thereto. A case in which a difference in characteristics may occur during the stopping period of development cartridges is also included because the developing surface of the developing roller is divided into two of inside and outside. If exposure period to the outside becomes, for example, long, a toner to stick to changes in quality, and it is included in a problem by leaving banding when development surface of a developing roller changes in quality by a toner to stick to. In addition, such problems are solved by rotating the developing roller.

Moreover, an another image forming apparatus suggests a construction which permits an image forming operation without causing a problem, such as noise, even when development cartridges are not accommodated (mounted) at all accommodating positions of the rotary unit (for example, see JP-A-2003-50494).

However, in a case in which development cartridges containing the same color toners are not mounted at accommodating positions adjacent to the developing rotary unit, when a toner within a development cartridge used runs out in forming a large amount of monochromatic images, the rotational operation (the changeover operation of development cartridges) should be repeated to move a development cartridge to be used to a developing position, which may take much time.

Here, as the image forming apparatus including the rotary unit, an image forming apparatus provided with a partition plate which partitions the interior of a container of a development cartridge, which contains toner, into a small space within which a supply roller rotates is known. In the image forming apparatus, it is necessary to put together (refresh) the toner within the container once by rotating the rotary unit so as to turn a development cartridge upside down after a certain amount of images has been formed, and then perform an action of replenishing toner into the space within which the supply roller rotates.

Specifically, in such as image forming apparatus, even before the toner within the development cartridge runs out, an action of replenishing toner into the space within which the supply roller rotates is performed in parallel with performing a changeover operation in which the rotary unit is rotated at a predetermined timing to cause the developing roller to face the carrier.

From the foregoing, even in a case in which the development cartridges containing the same color toners are mounted at all accommodating positions of the rotary unit, if the runout of toner occurs in any one of the development cartridges due to a difference between the consumptions of toner, the rotational operation of the rotary unit should be repeated to move a usable development cartridge to the developing position, similar to the above, even during the rotational operation of the rotary unit accompanied with the operation of replenishing the other development cartridges with toner.

As thus described, when the changeover operation of development cartridges are repeated during continuous image forming operation, an operator suffer from stress because he/she thinks that the image forming is not smoothly performed, which becomes a problem.

SUMMARY OF THE INVENTION

Therefore, the object of the present invention is to provide an image forming apparatus capable of shortening the stopping period of a developing roller to realize image forming for a prolonged period of time, which does not need a frequent replenishing work of toner, and performing high-quality image forming by changing over a development cartridge to the other development cartridge as frequently as possible and driving the other development cartridge even in a type in which only a development cartridge to be used among a plurality of toner cartridges is driven.

Further, the other object of the present invention is to provide an image forming apparatus capable of continuously forming a monochromatic image at high speed without causing an operator to suffer from stress by extending the period of time for which image forming lasts by mounting a plurality of development cartridges containing the same color toners and changing over an existing development cartridge to the adjacent development cartridge, similar to the operation of forming a color image, even when the monochromatic image is continuously formed.

In order to achieve the above object, according to the present invention, there is provided an image forming apparatus, comprising:

a carrier, on which an electrostatic latent image is formed;

a plurality of development cartridges, which develop the electrostatic latent image with toner to form a toner image to be transferred to a recording sheet; and a changeover unit, which changes the development cartridges so that any one of the development cartridges is moved so as to face the carrier for development, wherein at least two of the development cartridges contain the same color toners; and wherein the changeover unit repeatedly changes the development cartridges before an expiration of lifetime of one of the development cartridges which is positioned so as to face the carrier for the development.

In the above configuration, since a plurality of development cartridges which contains the same color toner is provided, image forming for a prolonged period of time can be realized without performing a replenishing work of toner (a replacing work of a development cartridge) for every runout of the toner in the development cartridge. Further, before a development cartridge in which a developing roller faces the carrier reaches should be replaced due to its lifetime, the development cartridge is changed to the next development cartridge, thereby drivingly rotating respective developing rollers sequentially. Accordingly, the period for which the developing rollers stop can be shortened as much as possible compared conventional image forming apparatuses. For example, the period for which the developing rollers are pressure-contacted with the supply rollers for supplying toners in containers at the same place can be shortened as much as possible compared as conventional image forming apparatuses. As a result, it is possible to avoid the occurrence of a so-called leaving banding that a trace at the position of pressure contact appears in a toner image to be transferred.

Preferably, wherein the changeover unit changes the development cartridges either before a processing of an image forming job is started or after the processing of the image forming job is finished.

In the above configuration, when a development cartridge facing the carrier receives an image forming job, the development cartridge is changed over to the next development cartridge without following its lifetime before or after the job is processed. In other words, a development cartridge is changed over to the next development cartridge at least one time between image forming jobs irrespective of the size of an image forming job. Accordingly, it is possible to repeatedly change over development cartridges so as not to cause leaving banding without hindering the processing of an image forming job.

Preferably, the image forming apparatus includes a clock unit which clocks an integrated time for which images are continuously formed in a state that one of the development cartridges is positioned so as to face the carrier. The changeover unit changes the one of the development cartridges to another one of the development cartridges so as to face the carrier when the integrated time which is clocked by the clock unit reaches a predetermined integrated time.

In the above configuration, a development cartridge is changed over to the next development cartridge without following its lifetime, when the integrated time of an image forming operation of the changeover reaches a set time. In other words, a development cartridge is repeatedly changed over to the next development cartridge when image forming processing is continuously performed. Accordingly, it is possible to repeatedly change over development cartridges so as not to cause leaving banding.

Preferably, the image forming apparatus includes a counter which counts an integrated number of recording sheets on which images are continuously formed in a state that one of the development cartridges is positioned so as to face the carrier. The changeover unit changes the one of the development cartridges to another one of the development cartridges so as to face the carrier when the integrated number which is counted by the counter reaches a predetermined integrated number.

In the above configuration, a development cartridge is changed over to the next development cartridge without following its lifetime, when the integrated number which is image-formed after the changeover reaches a set number. In other words, a development cartridge is repeatedly changed over to the next development cartridge when image forming processing is continuously performed. Accordingly, it is possible to repeatedly change over development cartridges so as not to cause leaving banding.

According to the above configuration, development cartridges containing the same color toners is not continuously used until a development cartridge to face the carrier cannot be used (before they reaches timing which should be replaced due to their lifetimes), but development cartridges are repeatedly changed over to the next development cartridge, for example, whenever a development cartridge is changed over to the next development cartridge before or after an image forming job, whenever the operation time after a changeover reaches a set time, or whenever the number of formed images after a changeover reaches a set number. Therefore, the developing rollers of the respective development cartridges are rotated one after another.

Accordingly, the period for which the developing rollers stop can be shortened as much as possible compared conventional image forming apparatuses, so that the occurrence of leaving banding can be avoided, image forming for a prolonged period of time can be realized without necessitating a replenishing work of toner, and high-quality image forming can be performed.

More preferably, when a next image forming command is received after a developing operation based on a previous image forming command is finished, the changeover unit changes one of the development cartridges which has performed the previous image forming operation to another one of the development cartridges to start another developing operation based on the next image forming command.

In the above configuration, since a plurality of development cartridges which contains the same color toners is provided, image forming for a prolonged period of time can be realized without performing a replenishing work of toner (a replacing work of a development cartridge) for every runout of the toner in the development cartridge. Further, whenever a development cartridge in which a developing roller faces a carrier receives an image forming command, the development cartridge is repeatedly changed over to a next development cartridge, thereby drivingly rotating respective developing rollers and supply rollers sequentially. Accordingly, the period for which the developing rollers stop can be shortened as much as possible compared conventional image forming apparatuses. For example, the period for which the developing rollers are pressure-contacted with the supply rollers for supplying toners in containers at the same place can be shortened as much as possible compared as conventional image forming apparatuses. As a result, it is possible to avoid the occurrence of so-called leaving banding that a trace at the position of pressure contact appears in a toner image to be transferred.

Preferably, the changeover unit changes the development cartridges when the next image forming command is received at a discontinuity timing between developing operations.

In the above configuration, when development cartridges operate continuously, they are not changed over. Accordingly, it is possible to avoid the leading banding without delaying the time of completion of a whole image forming job due to a changeover operation of a development cartridge.

Preferably, wherein the changeover unit changes the development cartridges even when the next image forming command is received while the one of the development cartridges continuously performs developing operations.

In the above configuration, even when development cartridges operate continuously, they are changed over. Accordingly, development cartridges can be changed over for every processing of image forming jobs, and the leading banding can be avoided more reliably.

Preferably, the changeover unit changes one of the development cartridges which has performed a developing operation based on an image forming command to another one of the development cartridges which performs another developing operation based on a next image forming command which follows the image forming command.

In the above configuration, whenever a development cartridge in which a developing roller faces a carrier receives an image forming command (whenever its image forming is finished), the development cartridge is repeatedly changed over to a next development cartridge, thereby drivingly rotating respective developing rollers and supply rollers sequentially. Accordingly, the period for which the developing rollers stop can be shortened as much as possible compared conventional image forming apparatuses. For example, the period for which the developing rollers are pressure-contacted with the supply rollers for supplying toners in containers at the same place can be shortened as much as possible compared as conventional image forming apparatuses. As a result, it is possible to avoid the occurrence of so-called leaving banding that a trace at the position of pressure contact appears in a toner image to be transferred.

According to the above configurations, a plurality of development cartridges containing the same color toners can be continuously used until any development cartridge facing a carrier cannot be used, and is changed over to a next development cartridge for every reception of an image forming command. Therefore, the developing rollers and the supply rollers of the respective development cartridges can be rotated one after another, and the positions of mutual pressure contact between the developing rollers and the supply rollers can be changed.

More preferably, the image forming apparatus further includes a clock unit, which clocks a lapsed time from a completion of a previous developing operation for individual developer cartridge. The changeover unit changes the development cartridges in accordance with the lapsed time.

In the above configuration, since a plurality of development cartridges which contains the same color toner is provided, image forming for a prolonged period of time can be realized without performing a replenishing work of toner (a replacing work of a development cartridge) for every runout of the toner in the development cartridge. Further, on the basis of the lapsed time after the completion of an image forming operation of each development cartridge, a development cartridge to face the carrier is changed over, thereby driving rotating respective developing roller and supply rollers sequentially. Accordingly, the period for which the developing rollers stop can be shortened as much as possible compared conventional image forming apparatuses. For example, the period for which the developing rollers are pressure-contacted with the supply rollers for supplying toners in containers at the same place can be shortened as much as possible compared as conventional image forming apparatuses. As a result, it is possible to avoid the occurrence of a so-called leaving banding that a trace at the position of pressure contact appears in a toner image to be transferred.

Preferably, the changeover unit changes one of the development cartridges which has the longest clocking time by the clock unit so as to face the carrier for the development.

In the above configuration, the existing development cartridge can be changed over to a development cartridge having the longest lapsed time after the completion of a developing operation, that is, having the greatest possibility that the leaving banding occurs. Accordingly, a critical development cartridge can be preferentially changed over before the leaving banding occurs.

Preferably, the changeover unit changes one of the development cartridges so as to face the carrier when an image forming operation is started.

In the above configuration, the existing development cartridge is changed over to a development cartridge having the longest lapsed time from the completion of a developing operation, and then an image forming operation is started. Accordingly, a critical development cartridge can be preferentially changed over before the leaving banding occurs.

According to the above configuration, a plurality of development cartridges containing the same color toners can be continuously used until any development cartridge facing a carrier cannot be used, and on the basis of the lapsed time (stopping time) from the completion of the previous developing operation at the time of start of an image forming operation, for example, the existing development cartridge can be changed over to a development cartridge having the longest lapsed time. Therefore, the developing rollers and the supply rollers of the respective development cartridges can be rotated one after another preferentially from a development cartridge having longer stopping time, and the positions of mutual pressure contact between the developing rollers and the supply rollers can be changed.

Accordingly, the period for which the developing rollers stop can be shortened as much as possible compared conventional image forming apparatuses, so that the occurrence of leaving banding can be avoided, image forming for a prolonged period of time can be realized without necessitating a replenishing work of toner, and high-quality image forming can be performed.

According to the present invention, there is also provided an image forming apparatus, comprising:

a carrier, on which an electrostatic latent image is formed;

a plurality of development cartridges, which develop the electrostatic latent image with toners to form a toner image to be transferred to a recording sheet;

a rotary unit, which accommodates the development cartridges around a rotating shaft of the rotary unit, and rotates about the rotating shaft the development cartridges so as to move any one of the developer cartridges to face the carrier for development;

a controller, which controls a rotation of the rotary unit and a driving of the developer cartridges to form the toner image; and a confirming unit, which determines whether all of the developer cartridges are accommodated in the rotary unit, wherein the all of the development cartridges contain the same color toners; and wherein the controller starts an image forming operation when the confirming unit determines that the all of the developer cartridges are accommodated in the rotary unit.

In the above configuration, even when it is confirmed that development cartridges containing the same color toners is mounted at all accommodated positions of the rotary unit, the image forming operation of a monochromatic image is started. Accordingly, when an image forming operation is started and a development cartridge need to be changed over, the development cartridge can be rapidly changed over to the adjacent development cartridge.

Preferably, the image forming apparatus further includes a detecting unit which detects rest of lifetime of the developer cartridges. When a processing of an image forming job is started, the controller changes one of the development cartridges which has the longest rest of lifetime so as to face the carrier in accordance with information from the detecting unit to start the image forming operation.

In above configuration, a development cartridge having the longest rest of lifetime is preferentially used to start an image forming operation. As a result, the lifetimes of the development cartridge are averaged. Accordingly, when it is necessary to rotate the rotary unit to repeatedly perform the replenishing operation of toner, etc. before the toner in a development cartridge runs out, the period of time until the runout of toner occurs in any one of the development cartridges can be lengthened as much as possible, and an existing development cartridge can repeated changed over to the adjacent development cartridge to perform the replenishment of toner, etc.

Preferably, the controller changes a current development cartridge which is positioned to face the carrier to another development cartridge at a preset timing after an image forming job has started.

In the above configuration, after an image forming job has started, for example, the development cartridges are changed over at a set timing of every certain amount of image forming operation, etc. As a result the lifetimes of the development cartridges can be more averaged. Accordingly, the period of time until the runout of toner occurs in any one of the development cartridges can be lengthened as much as possible, and the existing development cartridge can be repeatedly changed over to the next development cartridge.

Preferably, the rotary unit is adapted to mount a development cartridge containing a color toner for forming a color image. The controller controls the image forming operation so as to be faster than a color image forming operation when the confirming unit determines that the rotary unit accommodates the development cartridges respectively containing the same color toners.

In the above configuration, both a color image and a monochromatic image can be formed, and when it is confirmed that development cartridges containing the same color toners are mounted at all the accommodated positions of the rotary unit, it is determined that an image forming apparatus is used as a machine for exclusive use which forms a monochromatic image. In this case, a part of the image forming operation or the whole image forming operation can be accelerated. In other words, it is necessary to operate development cartridges at a timing which does not cause color shift, etc. during the operation of forming a color image by superposing multi-color toners on each other. However, in forming a monochromatic image, it is unnecessary to superpose toners on each other and it is possible to make the image forming operation faster than the color image forming operation to thereby perform the changeover operation of development cartridges and the forming or transfer operation of a toner image. Accordingly, the forming precision of a monochromatic image can be improved, and a job of forming a monochromatic image can be rapidly finished.

According to the above configurations, since the image forming operation of a monochromatic image starts only when the development cartridges containing the same color toners are mounted at all the accommodating positions of the developing rotary unit, when a development cartridge need to be changed over, the development cartridge can be rapidly changed over to the adjacent development cartridge to continue the image forming.

In this case, a development cartridge having the longest rest of lifetime is preferentially used among the development cartridges, or the development cartridges are changed over at a certain set timing even during continuation of the image forming operation. Thereby, the lifetime of the development cartridges can be averaged, the period of time until the runout of toner occurs in any one of the development cartridges can be lengthened, so that the operation of changing over an existing developer to the adjacent development cartridge can last for a prolonged period of time.

Moreover, when the image forming apparatus is used as a machine for exclusive use which forms a monochromatic image, image forming operation is made faster than the color image forming operation, so that the image quality of a monochromatic image can be improved and the forming speed of a monochromatic image can be increased.

Accordingly, the image forming operation can be rapidly repeated without repeating the rotational operation of the developing rotary unit, and a monochromatic image can be continuously formed to finish the image forming operation without stress.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Hereinafter, embodiments of the present invention will be described with reference to the accompanying drawings. FIG. 1 to FIG. 6 show a printer which is one example of an image forming apparatus according to a first embodiment of the present invention.

Figure 1:
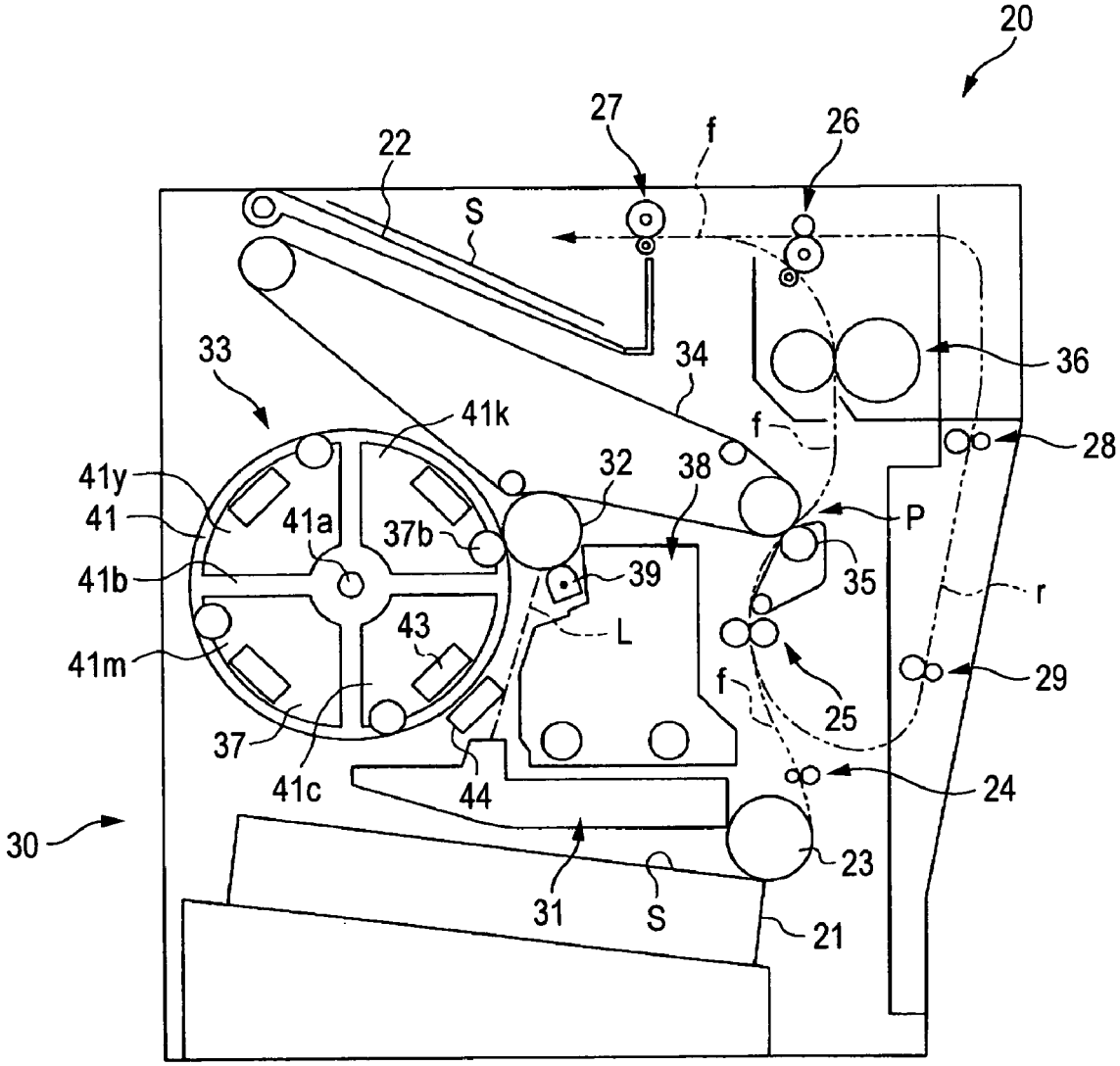
FIG. 1 is a perspective front view of an example of a printer to which an image forming apparatus according to a first embodiment of the present invention is applied, which illustrates a schematic overall construction thereof.
Figure 2:
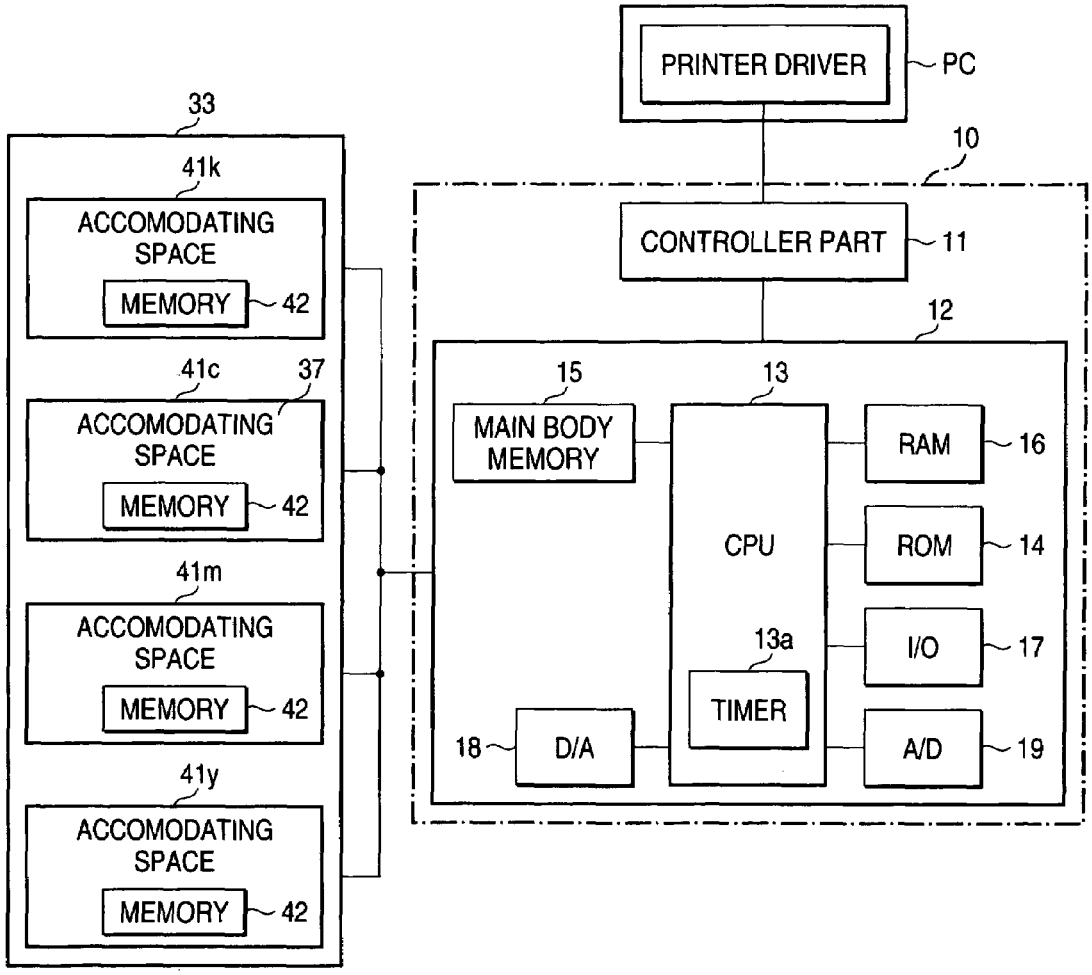
FIG. 2 is a block diagram for explaining the drive control relationship of the printer.

In FIG. 1 and FIG. 2, the printer is a printer which produces and outputs images such as characters, for example, which is used in a state of being connected to a personal computer PC. In the printer, a control unit 10 connected to the personal computer PC generally controls a sheet conveying unit 20 as an image recording unit 30 to form (print) an image on a recording sheet S (a recording medium).

The control unit 10 includes a control part 11 and an engine control part 12 which are mounted on a circuit board loaded into the printer so as to execute processing control of various kinds of data and drive control of operating parts according to a program set up in advance.

The control part 11 communicates various kinds of information, such as a print command, with a printer driver of the personal computer PC, and receives image data to be printed (image-formed) on the recording sheet S to temporarily store it, as its CPU (not shown) executes various processing procedures according to a processing program stored in a memory (not shown). Because the image data (image information signals) received from the personal computer PC is so-called RGB data of red (R), green (G) and black (B), the control part 11 converts the RGB data into image data as so-called YMCK data of yellow (Y), magenta (M), cyan (C) and black (K) which can be printed, and read the converted image data out of the memory to transfer it to the engine control part 12.

Briefly, as a CPU (not shown) of the controller unit 11 executes various processing procedures according to a processing program stored in a memory (not shown), the control part 11 communicates various kinds of information, such as a print command, with a printer driver of the personal computer PC, and receives image data to be printed (image-formed) on the recording sheet S to temporarily store it. In this case, when the image forming control is executed, the CPU 13 clocks various kinds of time, etc. using a built-in timer (a clock unit) to operate respective parts of the apparatus optimally.

In addition, in FIG. 2, an I/O interface 17 connects the control part 11, the sheet conveying unit 20, the image recording unit 30, and the engine control unit 12 with each other so that it can communicate various kinds of information. A D/A converter 18 convert a digital signal into an analog signal or an AND converter 19 converts an analog signal into a digital signal so that the various kinds of information communicated among the control part 11, the sheet conveying unit 20 and the image recording unit 30 can be processed, respectively.

The sheet conveying unit 20 is constructed with an intermediate transfer belt 34, a transfer roller 35, and a pair of fixing rollers 36, which are also constituent elements of the image recording unit 30, in addition to a sheet cassette 21, a sheet discharge table 22, a pickup roller 23, a pair of conveying rollers 24, a pair of registration rollers 25, a pair of switching rollers 26, a pair of sheet discharge rollers 27, and a pair of reversing rollers 28 and 29. The sheet conveying unit 20 separates and conveys a plurality of recording sheets S loaded into the sheet cassette 21 one by one to feed the separated recording sheet to an image recording position P of the image recording unit 30, and thereby records and forms received image data such as characters on one side or both sides of the recording sheet S. Thereafter, the image-formed recording sheet S is carried out to the outside of the image forming apparatus and loaded onto the sheet discharge table 22.

Briefly, the pickup roller 23 rotates in pressure contact with a recording sheet S loaded on the sheet cassette 21, to thereby pull out the recording sheet S and separately feed it into a conveying path f one by one in cooperation with a separating member (not shown). The pair of conveying rollers 24 pinches and conveys the recording sheet S and butts a leading end of the recording sheet S against a nip of the pair of registration rollers 25, which is located downstream, thereby correcting skew. The pair of registration rollers 25 pinches and feeds the recording sheet S to the recording position S so as to synchronize with the operation of the image forming apparatus 30.

At the recording position P of an image, the intermediate transfer belt 34 and the transfer roller 35 rotate while pinching the fed recording sheet S, to thereby record and form an image on one side of the recording sheet S and convey it. Further, the pair of fixing rollers 36 rotates while pinching the recording sheet S, to thereby fix the image on the recording sheet S and convey it to a further downstream side.

Thereafter, the pair of switching rollers 26 and the pair of sheet discharge rollers 27 carry out the recording sheet S from the pair of fixing rollers 36 and load it onto the sheet discharge table 22. By this process, a recording sheet S is fed to the recording position P of an image by the image forming apparatus 30, with its one side being used as a recording surface, is image-formed on its one side, and is then discharged onto the sheet discharge table 22.

At this time, when the engine control unit 12 receives an instruction of a double-sided image forming mode that an image is formed on both sides of the recording sheet S, the sheet conveying unit 20 stops temporarily at a position where the pair of conveying rollers 27 pinches a trailing edge of the recording sheet S carried out onto the sheet discharge table 22, and is then reversely driven together with the pair of switching rollers 26, to thereby send forth the recording sheet S having an image formed on its one side toward a reversing path r.

Thereafter, two pairs of reversing rollers 28 and 29 pass and convey the recording sheet S through the reversing path r while pinching the recording sheet S, and thereby feed the recording sheet S, whose upside is turned down with its trailing end while an image is formed on its one side being reversed to its leading end, again to the reversing path f and then transfer the recording sheet to the pair of registration rollers 25. By this process, the recording sheet S is fed again to the recording position P of an image by the image forming apparatus 30, with its other side (one side on which an image is not formed) being used as a recording surface of an image, is image-formed on its both sides, and is then discharged onto the sheet discharge table 22.

On the other hand, the image recording unit 30 includes a laser light scanning unit 31, a photoconductive drum (carrier) 32, a developing rotary unit 33, the intermediate transfer belt 34, the transfer roller 35, and the pair of fixing rollers 36. The image recording unit 30 records and forms the received image data such as characters, using an electrophotographic method, on one side or both sides of the recording sheet S which is conveyed by the sheet conveying unit 20 and fed to the recording position P.

Briefly, the laser light scanning unit 31 selectively irradiates the surface of the photosensitive drum 32 with laser light L on the basis of received image data to expose and scan the surface, thereby forming the electrostatic latent image based on the image data on the surface of the photosensitive drum 32. The developing rotary unit 33 accommodates a development cartridge 37 for each color, which develops an electrostatic latent image on the photosensitive drum 32 with yellow (Y), magenta (M), cyan (C) and black (K) toners, and sticks contained toner to the photosensitive drum 32 by causing a certain development cartridge 37 to face the photosensitive drum 32 according to the image data which forms an electrostatic latent image, thereby developing the electrostatic latent image by using a toner.

In the case of a monochromatic image, the intermediate transfer belt 34 receives a toner image formed with black (K) toner formed on the photosensitive drum 32, and holds, on its belt surface, the toner image to be transferred (simply referred to as a toner image) onto the recording sheet S. Further, it seems to be repeated, and the intermediate transfer belt 34 receives yellow (lateral), cyan (C), a toner image by a toner of magenta (M) formed on photoconductive drum 32 in sequential (an order is not limited to this) for the case a color image, and it is formed, and a toner image of a collar to copy on recording sheet S in the belt front face is held. The transfer roller 35 is pressure-contacted the recording sheet S fed to a position (the recording position P of an image) between itself and the intermediate transfer belt 34 so as to sandwich it therebetween, and pinches and carries the recording sheet, thereby transferring the toner image to the recording sheet S. In other words, the present embodiment employs a transfer method in which the intermediate transfer belt 34 relays the transfer of a toner image to a recording sheet S. In addition, it goes without saying that toner is transferred to the recording sheet S via the photosensitive drum 32 and the intermediate transfer belt 34 from the development cartridge 37.

Pair of fixing rollers 36 fixes the toner image by 2 that heating is pressed against recording sheet S which a toner image is transferred, and has been conveyed by recording position P of an image, and moreover it pinches, and the recording sheet S is carried to a downstream. By this, as for recording sheet S, a monochromatic image based on received image data or a color image leave the Recording formation (fixation) in a one side or both sides, and an in succession image is recorded, and plural pieces can be formed by repeating such operation.

In addition, the toner which remains on the photosensitive drum 32 after being transferred to the intermediate transfer belt 34 is neutralized and collected by a cleaning unit 38. Thereafter, the photosensitive drum 32 is charged to an electric potential by an electrifier 39 which receives toner from the development cartridge 37 of the developing rotary unit 33 to stick the toner thereto. Although the illustration is omitted, similarly, the intermediate transfer belt 34 is also neutralized or charged to repeatedly perform the transfer (sticking) and collection of toner.

The developing rotary unit 33 of the printer is constructed such that a plurality of the development cartridges 37, which develops an electrostatic latent image on the surface of the photosensitive drum 32 with toner, are accommodated in a cylindrical housing 41. The developing rotary unit 33 changes a certain development cartridge 37 to face the photosensitive drum 32 by rotating a housing 41 about a rotating shaft 41*a* on the basis of a print command including image data. The print command is received at the CPU 13 of the engine control unit 12 from the personal computer PC via the control part 11. In other words, the CPU 13 of the engine control unit 12 is configured as a changeover unit.

Specifically, the housing 41 is divided into equal spaces 41*y*, 41*m*, 41*c* and 41*k*, which extend axially around the rotating shaft 41*a*, by a frame 41*b* which substantially coincides with a direction normal to the rotating shaft 41*a*. A printer can form a color image, a multi-color image and a monochromatic image on one side or both sides of the recording sheet S by accommodating (mounting) the development cartridges 37 containing toner within the respective spaces 41*y*, 41*m*, 41*c* and 41*k*. For example, such a printer can be used as an apparatus capable of printing a color image through a monochromatic image by accommodating the development cartridges 37 which respectively contain toners for the respective colors of yellow (Y), magenta (M), cyan (C) and black (K) within the respective accommodating spaces 41*y*, 41*m*, 41*c* and 41*k* of the housing 41, and by changing the development cartridges 37 which develops an electrostatic latent image on the photosensitive drum 32 by rotating the developing rotary unit 33 (housing 41) so that the respective color toners can be selected overlappingly. Further, the printer can be used as a machine for exclusive use which forms a monochromatic image (a monochromatic image) by accommodating the development cartridges 37 containing toners of the same color within all the accommodating spaces 41*y*, 41*m*, 41*c* and 41*k* of the housing 41, and by sequentially changing the development cartridges 37 which develop an electrostatic latent image on the photosensitive drum 32 by rotating the developing rotary unit 33. In this case, image forming can be continued (performed continuously for a prolonged period of time) without performing a replacing work (a replenishing work of toner) of the development cartridges 37 for every runout of a toner. In addition, the printer can be used as an apparatus capable of forming a multi-color image and a monochromatic image whose color is separated by the respective color toners by accommodating development cartridges 37 of the same color within at least two of the accommodating spaces 41*y*, 41*m*, 41*c* and 41*k* of the housing 41.

As described above, the development cartridges 37 are configured to have the same interior along with its appearance so that the development cartridges 37 can be accommodated within the respective accommodating spaces 41*y*, 41*m*, 41*c* and 41*k* of the housing 41 and be rotated about the rotating shaft 41 so as to sequentially face the photosensitive drum 32, and can develop an electrostatic latent image on the surface of the photosensitive drum 32 with toner by the same drive control.

Figure 3:
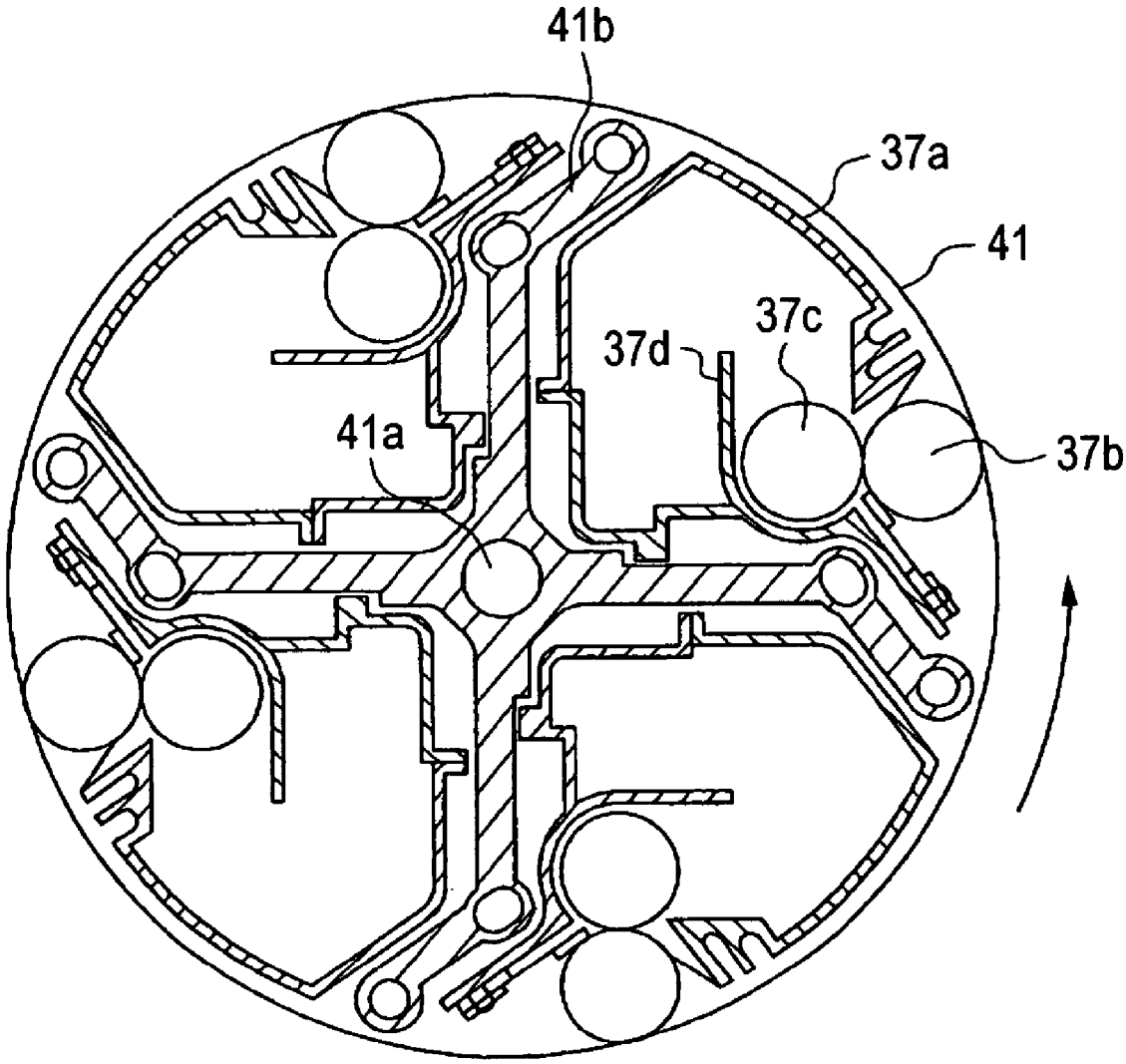
FIG. 3 is a partial longitudinal front view illustrating a developing rotary unit which accommodates development cartridges.

As shown in FIG. 3, each development cartridge 37 has a container 37*a*, a developing roller 37*b*, a supply roller 37*c* and a partition plate 37*b*. The containers 37*a* are formed in a similar shape and contain toners so that the container 37*a* can be accommodated within the respective accommodating spaces 41*y*, 41*m*, 41*c* and 41*k* of the housing 41. The developing roller 37*b* is rotationally supported at the outer circumferential side of the container 37*a* spaced from the rotating shaft 41*a* of the housing 41, and sticks a toner transferred from the supply roller 37*c* to the photosensitive drum 32. The supply roller 37*c* is rotationally supported by the container 37*a* so as to be adjacent to the developing roller 37*b* at the rotating shaft 41*a* of the housing 41, and rotates in pressure contact with the developing roller 37*b* to thereby grind and charge its ambient toner and supply it. The partition plate 37*d* is installed so as to surround the supply roller 37*c*, and partitions a toner-containing space of the container 37*a* while communicating a space at the rotating shaft 41*a* of the housing 41 with an upper portion in a space where the supply roller 37*c* is installed in the rotating direction.

By the above construction, the development cartridge 37 supplies a toner within the space of the container 37*a* at its outer circumferential side with the developing roller 37*b* which rotates in pressure contact with the supply roller 37*c*. Further, when the housing 41 rotates in a counterclockwise direction by 90 degrees in FIG. 3 and has finally rotated in a 180-degrees arc, the development cartridge 37 put together the toners contained at the rotating shaft 41*a* and the supply roller 37*c* of the container 37*a*, in the upper portion of the partition plate 37*d* (lower side in FIG. 3). Thereafter, the housing 41 further rotates by 90 degrees, to thereby stir and refresh the toner contained within the container 37*a*, and to collect the contained toner toward the supply roller 37*c* so that the toner can be supplied to the developing roller 37*b*. As described above, since the developing rotary unit 33 according to the present embodiment replenishes the supply roller 37*c* with toner by the rotation of the housing 41 while agitating the toner, devices (so-called agitator and auger) for agitating and replenishing contained toner can be appropriately omitted. It is noted herein that the development cartridge 37 is needed to rotate the developing rotary unit 33 and perform replenishing and agitating operations of a toner when the used amount of a toner to be detected exceeds a preset value on the basis of, for example, a counted value by a toner counter, a dot number of an image, an integrated time of developing operation (image forming) time, an integrated number of developed sheets, or a actually measured residual amount of a toner before the toner to be supplied with the developing roller 37*b* runs out.

Further, a nonvolatile memory 42 and a development-side connector 43 are respectively provided in the development cartridge 37, and a control-side connector 44 is disposed at the developing rotary unit 33. The nonvolatile memory 42 rewritably stores various kinds of information such as a color, a manufacturing date, and a consumption of a toner to be contained along with identification information such as a manufacturer's serial number. The development-side connector 43 performs reading and rewriting of information which is connected to the nonvolatile memory 42 and stored therein. The control-side connector 44 is disposed so as not to move to the outer circumference of the developing rotary unit 33, and communicates various kinds of information in a non-contact manner when any one of the development-side connectors 43 of the development cartridges 37 faces the development-side connector. By this construction, the engine control unit 12 of the control unit 10 can appropriately interpret various kinds of information such as color information of toners in the development cartridges 37, the existence or non-existence and positions of the development cartridges which are accommodated within the accommodating spaces 41*y*, 41*m*, 41*c* and 41*k* of the developing rotary unit 33, and a life time of the development cartridges 37. In other words, the CPU 13 of the engine control unit 12 is configured as a confirming unit and a detecting unit.

Figure 4:
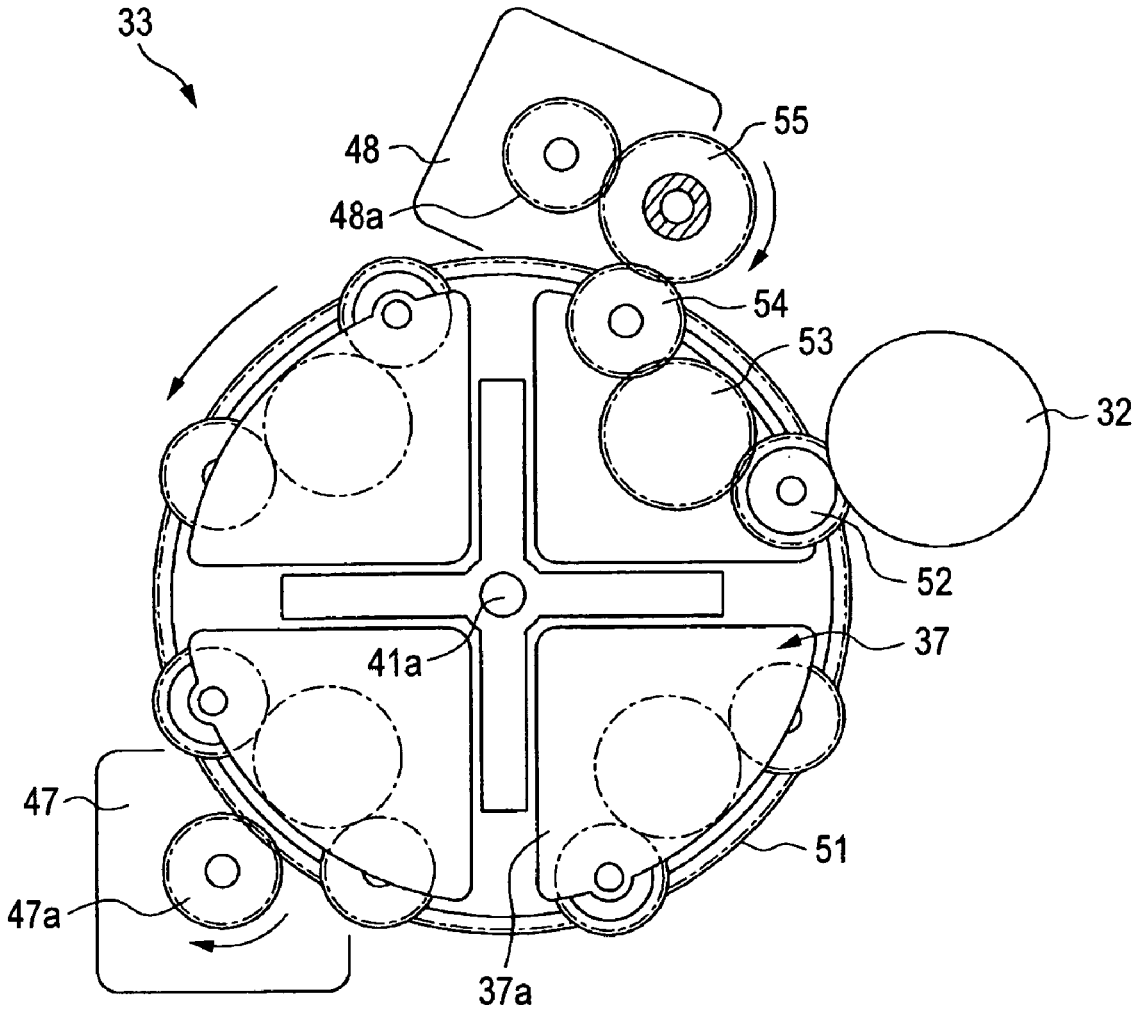
FIG. 4 is a perspective front view showing the transmission of a driving force of the developing rotary unit and development cartridges.
Figure 5:
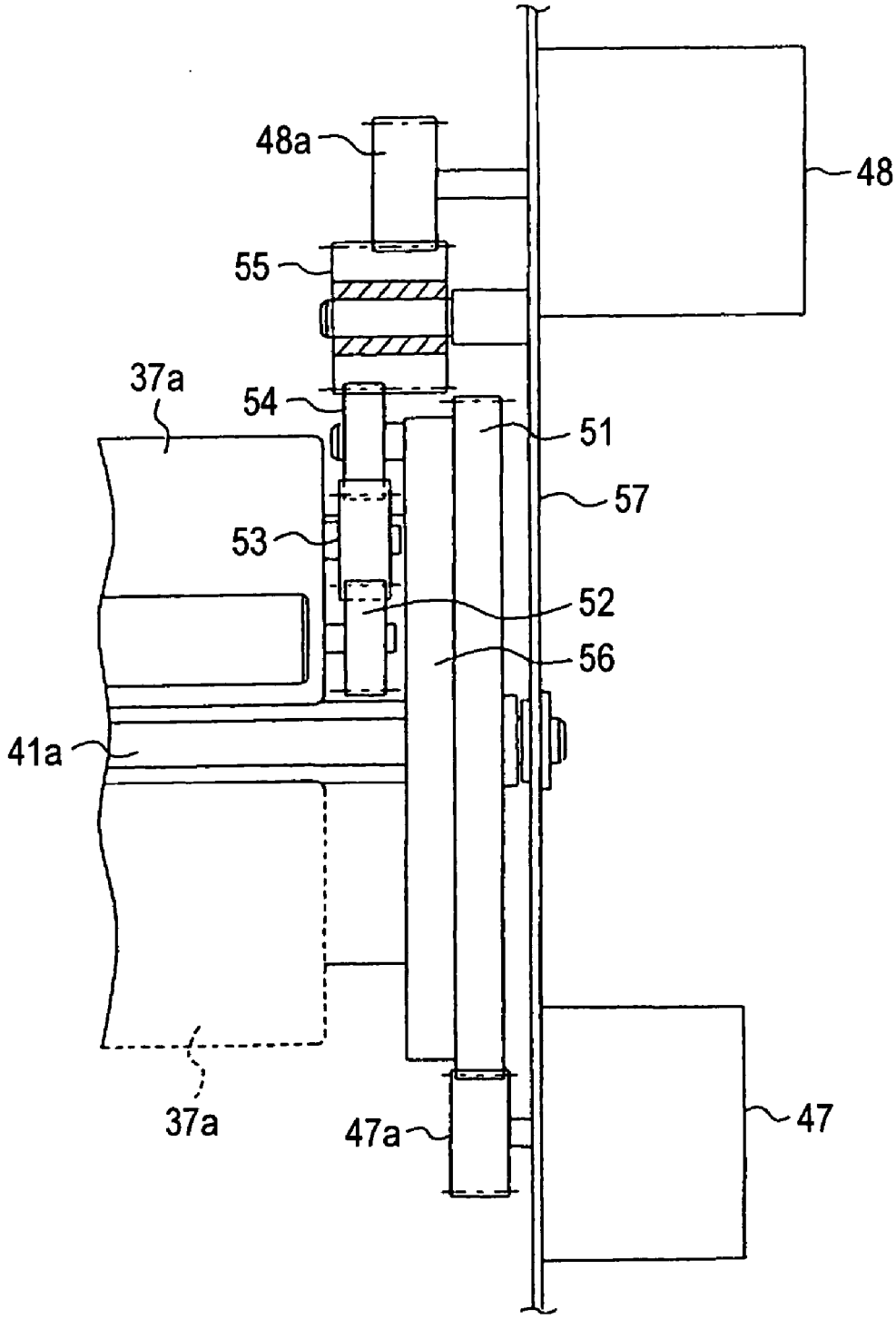
FIG. 5 is a perspective side view showing the transmission of a driving force of the developing rotary unit and development cartridges.
Figure 6:
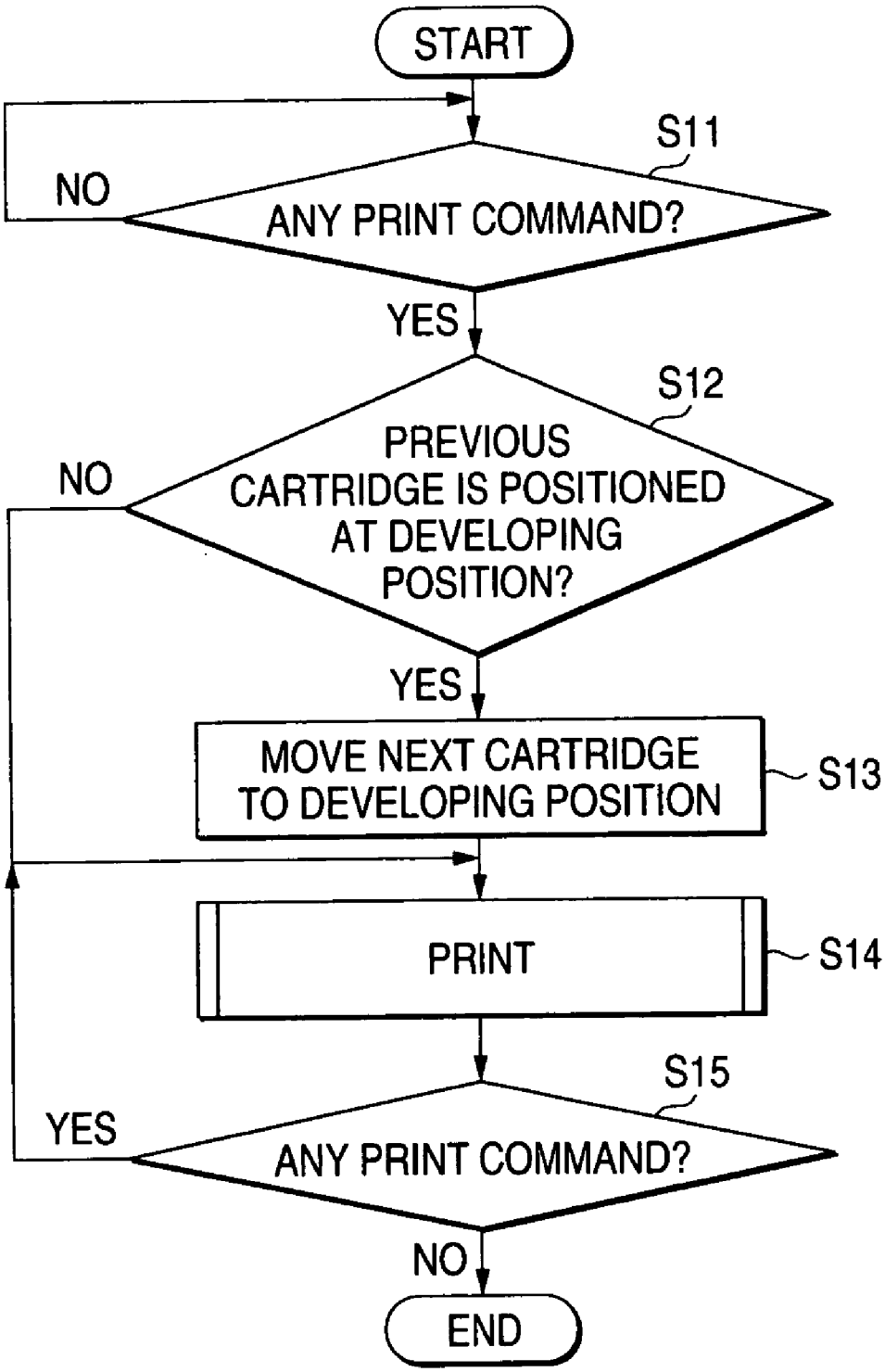
FIG. 6 is a flowchart for explaining the changeover control of the development cartridges.

On the other hand, the developing rotary unit 33 which accommodates the development cartridges 37, as shown in FIG. 4 and FIG. 5, is configured to be operated by a wheel train arrangement which is obtained by allowing a rotary drive motor 47, a developing drive motor 48, a rotary input gear 51, a developing roller gear 52, an idler gear 53, a developing input gear 54, and a developing drive gear 55 to engage each other. A driving force of the rotary drive motor 47 is transmitted to rotationally drive the housing 41, while the development cartridges 37 receive a driving force from the developing drive motor 48 to rotationally drive the developing roller 37*b* and the supply roller 37*c*.

Briefly, the rotary input gear 51 is fixedly provided at one end of the housing 41 so as to be coaxial with the rotating shaft 41*a*, and meshes with a motor pinion 47*a* of the rotary drive motor 47. The rotary drive motor 47 drives according to a control signal from the engine control part 12, whereby the developing rotary unit 33 rotate by 90 degrees to sequentially move the development cartridges 37 accommodated within the four accommodating spaces 41*y*, 41*m*, 41*c* and 41*k* to a position facing the photosensitive drum 32.

The developing roller gear 52 and the idler gear 53 are disposed at each of the development cartridges 37 and a total of four sets of the developing roller gears and idler gears are attached thereto. The developing roller gear 52 is fixedly provided at one end of the developing roller 37*b* so as to be coaxial therewith, and rotatably journalled to the container 37*a*, and the idler gear 53 meshes with the developing roller gear 52 and is rotatably journalled to the container 37*a*. By this construction, when a development cartridge 37 is replaced with a new one, the developing roller gear 52 and the idler gear 53 along with the developing roller 37*b* and the supply roller 37*c* are also pulled and replaced out of the housing 41 of the developing rotary unit 33.

On the other hand, the developing input gear 54 and the developing drive gear 55 are disposed at the housing 41. A total four developing input gears 54 are attached to correspond the development cartridges 37 of the respective accommodating spaces 41*y*, 41*m*, 41*c* and 41*k* of the developing rotary unit 33, and are rotatably journalled to the rotary frame 56 which rotates integrally with the rotary input gears 51 so as to be meshable with the idler gears 53 of the respective development cartridges 37 which are inserted or removed. One developing drive gear 55 is attached to correspond to the developing drive motor 48, and meshes the motor pinion 48*a* of the developing drive motor 48. Further, the developing drive gear 55 is rotatably journalled to the main body frame 57 at a position which meshes a developing input gear 54 which is rotated, and is connected to the developing roller gear 52 and the idler gear 53 of the development cartridge 37 to be operated, thereby constructing a wheel train of a transmission path along which a driving force of the developing drive motor 48 is transmitted.

In other words, when the engine control part 12 controls the driving of the rotary drive motor 47 to rotate the developing rotary unit 33, and thus a development cartridge 37 is moved to its developing position which faces the photosensitive drum 32, the development cartridge 37 can receive a driving force from the developing drive motor 48 whose driving is controlled by the engine control part 12 via a wheel train composed of the developing roller gear 52, the idler gear 53, the developing input gear 54 and the developing drive gear 55 to operate the developing roller 37*b* and the supply roller 37*c*. On the other hand, when the developing input gear 54 departs from the developing drive gear 55 meshing the motor pinion 48*a* of the developing drive motor 48 and slips out of the wheel train from the developing drive motor 48, the development cartridge 37 just moves by 90 degrees with respect to the rotational operation of the developing rotary unit 33. In addition, the developing drive gear 55 has a one-way clutch built therein so as to idle in a reverse rotation direction of the developing roller 37*b*. Thereby, when the developing drive gear 55 meshes with the rotating developing input gear 54, it can escape to avoid damaging tooth tips caused by the mutual collision of the gears.

Also, the CPU 13 of the engine control part 12 executes various control operations according to control programs in the ROM 14 after power-on. At the time of the power-on or the replacement of a development cartridge 37, the CPU 13 performs non-contact communication via the connectors 43 and 44, to thereby keep (store) existence or non-existence of the development cartridges 37 set in the accommodating spaces 41*y*, 41*m*, 41*c* and 41*k* of the developing rotary unit 33 in the main body memory 15. Further, the CPU 13 reads out various kinds of information written in the nonvolatile memory 42 of each development cartridge 37 via the connectors 43 and 44, and keeps location information of the respective development cartridges 37, color information or consumption (residual amount) of toners, or the like in the main body memory 15. Moreover, during image forming operation or after the completion of image forming, the CPU 13 writes or rewrites various kinds of information such as the amount of a toner consumed in forming an image and the residual amount of the development cartridges 37 in the nonvolatile memory 42 of each development cartridge 37 via the connectors 43 and 44.

At this time, if the CPU 13 determines that the development cartridges 37 containing the respective color toners of yellow (Y), magenta (M), cyan (C) and black (K) are set in the accommodating spaces 41*y*, 41*m*, 41*c* and 41*k* of the developing rotary unit 33, the CPU 13 executes a general image forming control to rotate the developing rotary unit 33 according to the image data sent from the control part 11, thereby a color image, a multi-color image or a monochromatic image on one side or both sides of the recording sheet S. In other words, whenever the development cartridges 37 for the respective color toners mounted to the developing rotary unit 33 receive print commands of image data, their positions are appropriately changed over and operated according to kinds of images based on the image data and operate in the changed positions. By this construction, the positions of the development cartridges 37 are appropriately changed whenever the position of pressure contact between the developing roller 37*b* and the supply roller 37*c* during the stop of each development cartridges 37 is moved, which effectively prevents a trace of pressure-contact with the supply roller 37*c* from leaving on the surface of developing roller 37*b*. Accordingly, when development cartridges 37 which contain different color toners are set in the developing rotary unit 33, the CPU 13 executes image forming control. Thereby, a stripe-shaped trace caused by a trace between the developing roller 37*b* and the supply roller 37*c* can be prevented from appearing on a toner image which is adhered to and formed on an electrostatic latent image on the surface of the photosensitive drum 32 during every one rotation of the developing roller 37*b*, and high-quality image forming can be performed without occurrence of so-called leaving banding.

Further, if the CPU 13 determines that development cartridges 37 containing the same color toners are mounted in all the accommodating spaces 41*y*, 41*m*, 41*c* and 41*k* of the developing rotary unit 33, the CPU 13 executes an image forming control while operating the set development cartridges 37 as equally as possible by repeatedly changing over the development cartridges 37 at an appropriate timing before the development cartridges 37 reach their usable limits, and thus records and forms a monochromatic image according to the image data sent from the control part 11 on one side or both sides of a recording sheet S. Here, the lifetime of the development cartridges 37 means that need for changing over or replacing the development cartridges is occurred. For example, the lifetime of the development cartridges 37 means that the runout of a contained toner occurs, a toner around the supply roller 37*c* runs out and need for rotating developing rotary unit 33 occurs, or a contained toner cannot be frictionally charged any more.

Figure 9:
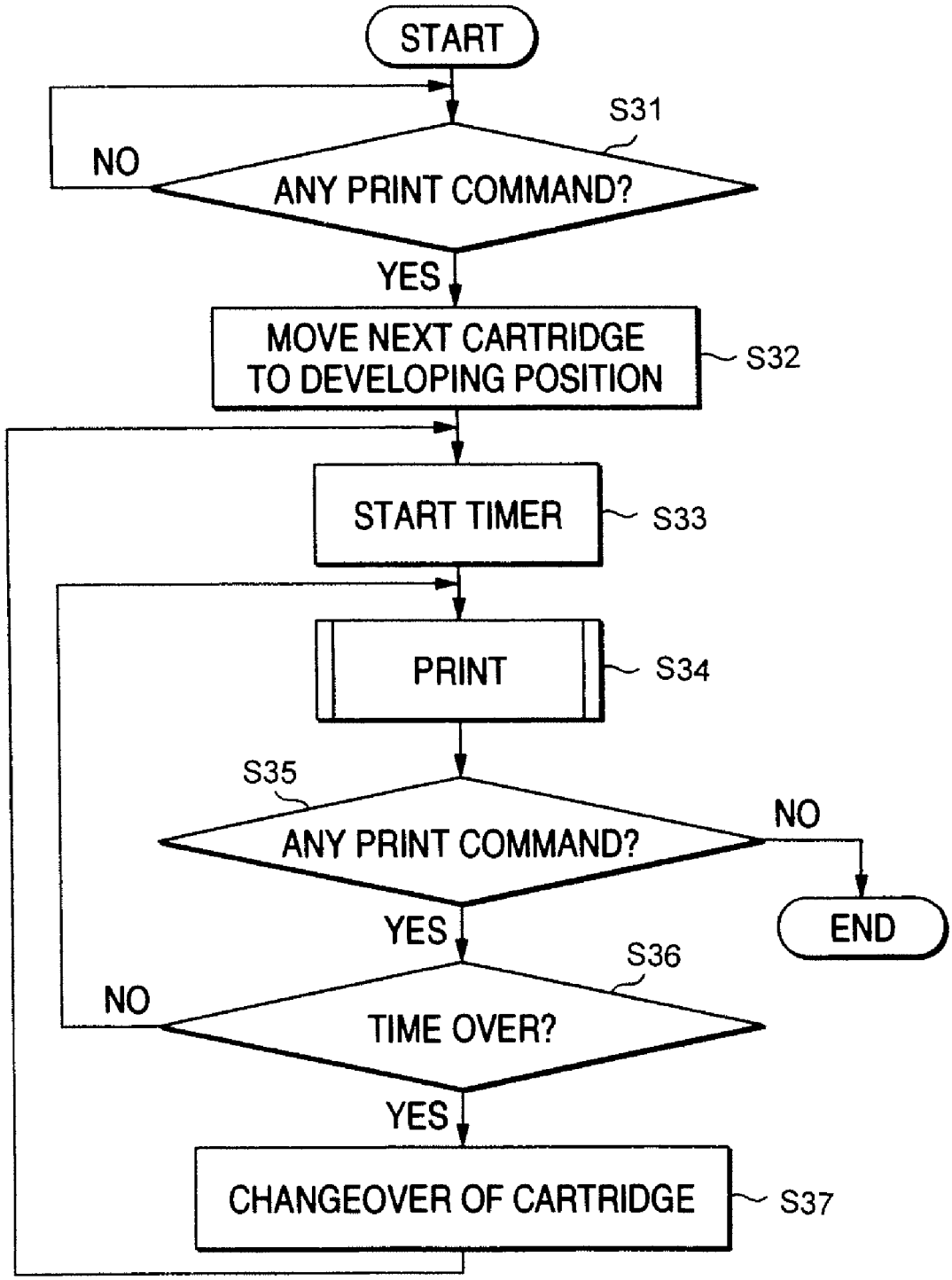
FIG. 9 is a flowchart for explaining the changeover control of the development cartridges according to a third embodiment of the invention.

Specifically, for example, if development cartridges 37 which contain a black (K) toner are mounted in all the accommodating spaces 41*y* and 41*k* of the developing rotary unit 33 to form a black-and-white monochromatic image because documents, etc. are often printed, the CPU 13, as shown in a flowchart of FIG. 9, executes an image forming control including the changeover control of the development cartridge 37 in accordance with the cumulative operation time.

Further, if the CPU 13 receives a print command of image data of a monochromatic image from the control part 11 (Step S31), the CPU 13 controls the developing rotary unit 33 to be rotated to change over the development cartridges 37 (Step S32). For example, if the development cartridge 37 mounted in the accommodating space 41*c* stands by in a state facing the photosensitive drum 32, the development cartridge 37 accommodated in the next accommodating space 41*k* is moved to the developing position facing the photosensitive drum 32, so that the development cartridge 37 to be used is changed over. Next, the CPU 13 causes the built-in timer 13*a* to be started and clock an integrated time for which the developing operation (image forming) is performed (Step S33), and executes the drive control of the sheet conveying unit 20 and the image recording unit 30 for printing received data to form an image on one side or both sides of the recording sheet S (Step S34).

By the above processes, when the CPU 13 receives a print command during a standby status, in the development cartridge 37, the developing operation which drivingly rotates the developing roller 37*b* and the supply roller 37*c* is started after a changeover operation of the development cartridge 37 which rotates the developing rotary unit 33. Accordingly, the position of pressure contact between the developing roller 37*b* and supply roller 37*c* of the development cartridge 37 can be changed sequentially whenever a development cartridge 37 receives a print command at least after its standby. As a result, a trace of pressure contact with the supply roller 37*c* can be effectively prevented from leaving on the surface of the developing roller 37*b*. Here, in the present embodiment, the CPU 13 controls the developing rotary unit 33 to be rotated to change over the development cartridge 37, using a print command as a trigger before executing an image forming operation. However, the present invention is not limited thereto, and the CPU 13 may control to rotate the developing rotary unit 33 so as to change over the development cartridge 37 after the image forming operation by the previous print command is completed (or before the CPU 13 proceeds to the standby status).

Next, the CPU 13 checks whether or not there is a next print command (an unprocessed print command) (step S35). If there is no unprocessed print command, the CPU 13 stops the image forming control. However, if there is any unprocessed image command, the CPU 13 checks whether or not the integrated operation time, using the same development cartridge 37, which is clocked by the timer 13*a*, exceeds a preset time (Step S36). If the integrated operation time does not exceed the preset time, the CPU 13 directly returns to Step S34 to continue printing (developing) of the image data by the same development cartridge 37, to repeat forming of an image onto the recording sheet S (Steps S34 to S36). It is noted herein that it is preferable that the preset time be set in a rewritable memory, or included and set in a control program. For example, it is preferable that the preset time is set ½, ⅓, etc. shorter than the development operation time which needs replenishing toner into space of the developing roller 37*b* and the supply roller 37*c* by rotating the developing rotary unit 33. Extremely, the processing time for one recording sheet S may be set as the preset time as long as a problem due to image forming processing speed (so-called, throughput) or noise does not occur.

On the other hand, if the integrated operation time while using the same development cartridge 37 which is clocked by the timer 13*a*, exceeds a preset time, the developing rotary unit 33 is rotated before the development cartridges 37 reach their usable limits (lifetime), the development cartridge 37 is changed over so that a development cartridge 37 mounted in the next accommodating space 41*m* is moved to the developing position facing the photosensitive drum 32 (Step 37). Thereafter, the CPU 13 returns to Step S13, the development cartridge 37 are changed over for every set time until any unprocessed print command doest not exist, to repeat a series of image forming operation, and thereby record and form a monochromatic single color image on one side or both sides of a recording sheet S (Steps S33 to S37).

By the above processes, the development cartridges 37 are changed over to drivingly rotate the developing roller 37*b* and the supply roller 37*c* whenever the integrated operation time exceeds a set time. Accordingly, the position of pressure contact between the developing roller 37*b* and supply roller 37*c* during their stopping can be sequentially changed over whenever the integrated operation time of a development cartridge 37 to be used exceeds a set time, in addition to the point of time of changeover of the development cartridge 37 when the CPU 13 receives a print command during standby status.

As a result, a trace of pressure contact with the supply roller 37*c* can be effectively prevented from leaving on the surface of the developing roller 37*b*.

In addition, even in a case in which development cartridges 37 containing the same color toners can be mounted at two or three of the accommodating spaces 41*y*, 41*m*, 41*c* and 41*k* of the developing rotary unit 33, high-quality image forming can be performed without leaving banding by rotating the developing rotary unit 33 to change over a development cartridge 37 to face the photosensitive drum 32 whenever the integrated operation time of a development cartridge 37 to be used exceeds a set time.

As thus described, in the present embodiment, since the development cartridges 37 are repeatedly changed over whenever the CPU 13 receives a print command during standby status or the integrated operation time exceeds a set time (without continuing to use the development cartridges up to their usable limit (lifetime)), in the case in which the development cartridges 37 containing the same color toners are set in the developing rotary unit 33, developing rollers 37*b* and supply rollers 37*c* of the respective development cartridges 37 can be rotated one after another, and thus the positions of mutual pressure contact therebetween can be changed.

Figure 7:
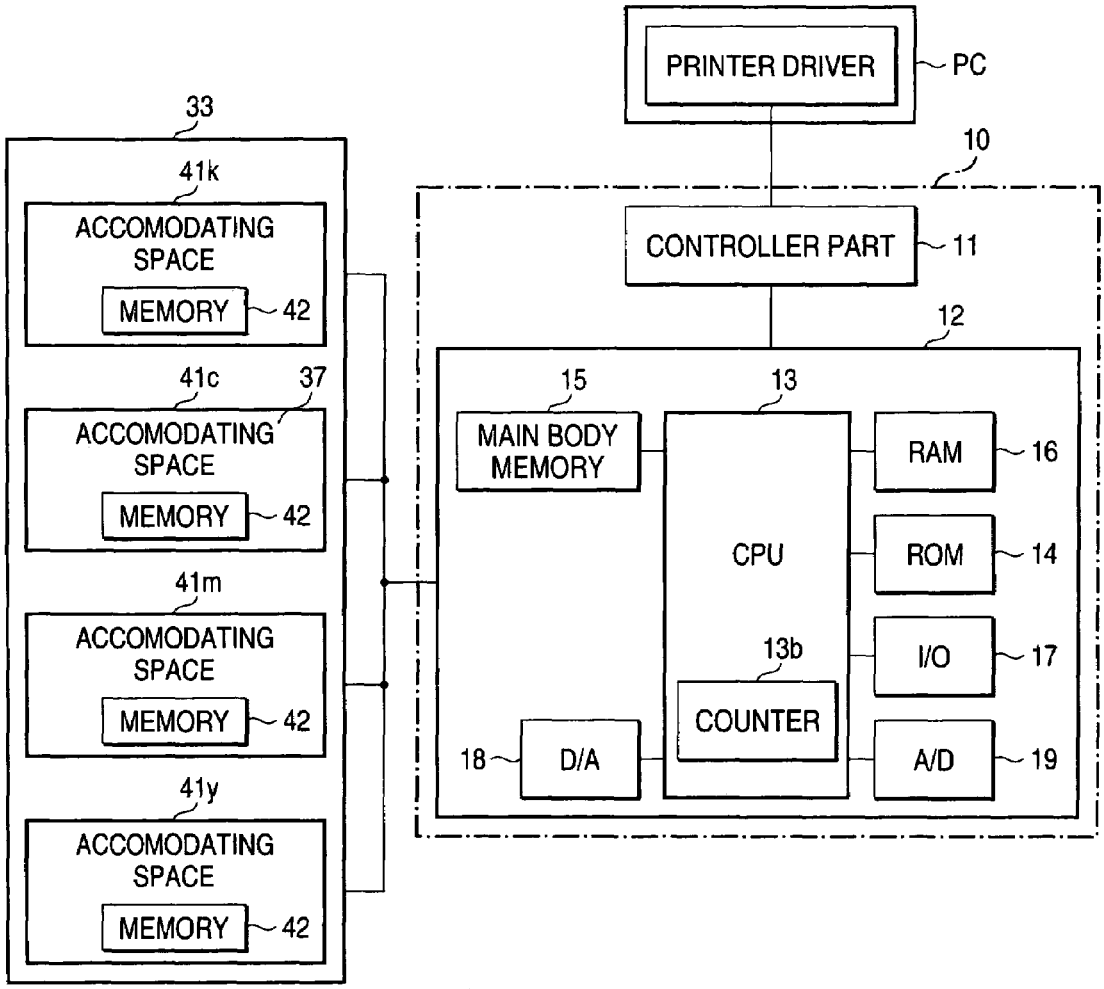
FIG. 7 is a block diagram of an example of a printer to which an image forming apparatus according to a second embodiment of the present invention is applied, which illustrates the drive control relationship thereof.
Figure 8:
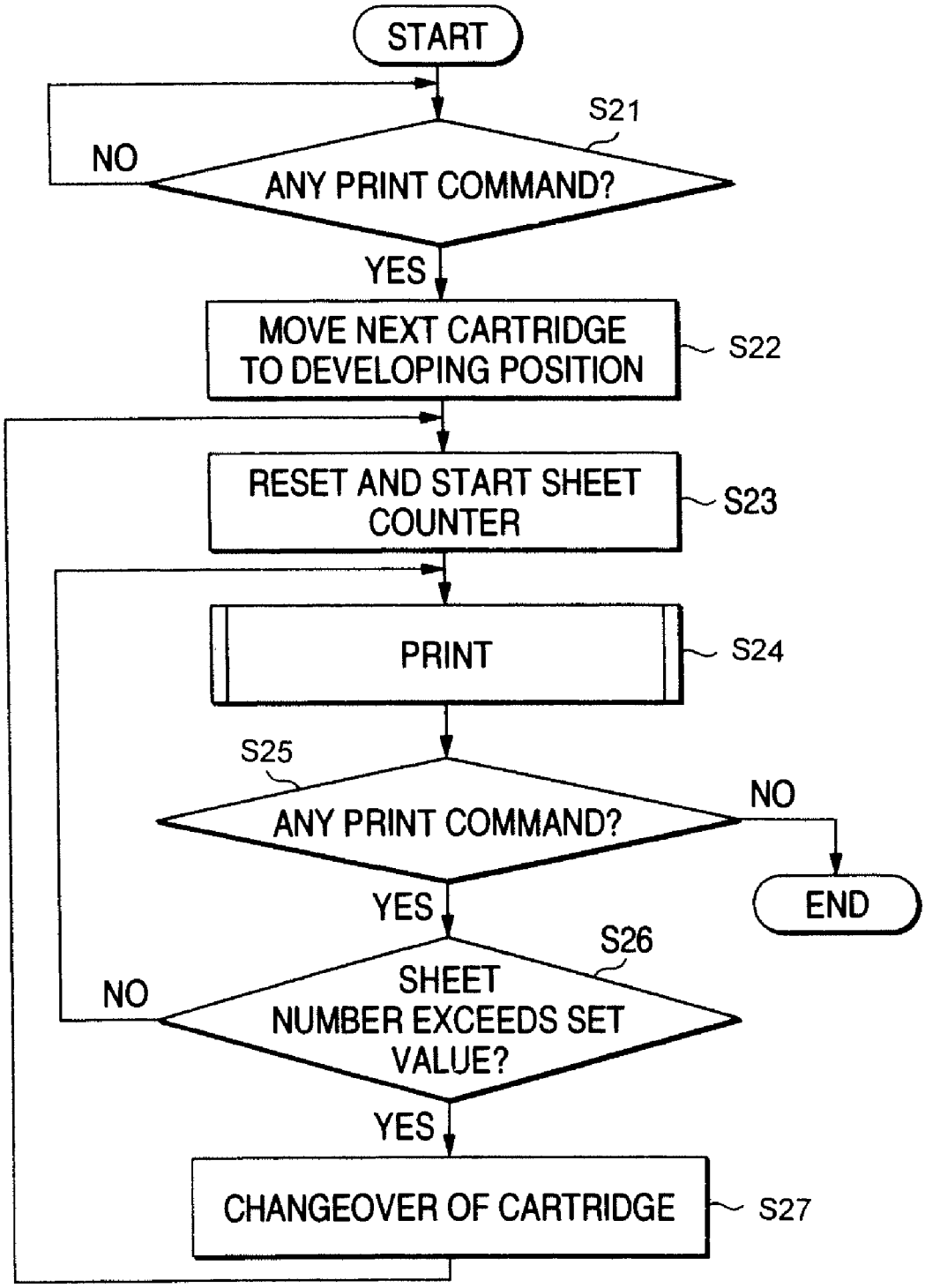
FIG. 8 is a flowchart for explaining the changeover control of the development cartridges.

Next, FIG. 7 and FIG. 8 show a printer being one embodiment of an image forming apparatus according to a second embodiment of the present invention. In addition, since the present embodiment is configured substantially similar to the above described embodiment, the same parts are denoted by the same reference numerals and the characterizing portions will be described with reference to the drawings referred to in the above embodiments.

In FIG. 7, when the CPU 13 of the engine control part 12 of the present embodiment executes an image forming control, the CPU 13 controls the built-in timer (a counting unit) 13*b* to count the number of processed recording sheets S, thereby optimally operating respective parts of the image forming apparatus, such as the sheet conveying unit 20 and the image recording unit 30.

The CPU 13 executes an image forming control including the changeover control of the development cartridges 37 according to the number of recording sheets S. For example, it is preferable that the number of processed recording sheets required for executing the changeover of a development cartridge 37 be set to ½, ⅓, etc. smaller than the number of developed images (the number of transferred toner images which needs replenishing toner into space of the developing roller 37*b* and the supply roller 37*c* by rotating the developing rotary unit 33. Extremely, the number of processed recording sheets may be set to one as long as a problem due to image forming processing speed (so-called, throughput) or noise does not occur. It is noted herein that the number of developed images may be the number of recording sheets S irrespective of forming an image onto one side or both sides thereof, but is preferably counted whenever toner images to be transferred onto one side of recording sheets S are developed in order to uniformly operate the development cartridges 37.

Also, when the CPU 13 forms a monochromatic image in a state in which development cartridges 37 containing, for example, a black (K) toner are mounted in all the accommodating spaces 41*y*, 41*m*, 41*c* and 41*k* of the developing rotary unit 33, as shown in a flowchart of FIG. 8, the CPU 13 executes an image forming control which repeatedly changes over the development cartridges 37 at an appropriate timing before they reaches their usable limits, according to the number of developed images. As a result, the CPU 13 executes the image forming control while operating the set development cartridges 37 as equally as possible, thereby recording and forming a monochromatic image according to the image data sent from the control part 11 on one side or both sides of the recording sheet S.

First, similar to the above embodiment, when the CPU 13 receives a print command from the control part 11 (Step S21), the CPU 13 controls the developing rotary unit 33 to be rotated to change over the development cartridge 37 to face the photosensitive drum 32 (Step S22), and controls a built-in timer 13*b* to be reset to start the counting of the number of images to be processed (Step S23), and executes an image forming control of received image data to record and form an image on one side or both sides of the recording sheet S (Step S24).

Next, when the CPU 13 confirms that there is any unprocessed print command (Step S25), the CPU 13 confirms the number of developed images, using the same development cartridge 37, which is counted by the counter 13*b* (Step S26). If the number of developed images does not exceed a set number, the CPU 13 directly returns to Step S14 to repeat the operation of forming an image onto a recording sheet S using the same development cartridge 37 (Steps S24 to S26).

On the other hand, if the number of developed images while using the same development cartridge 37 which is counted by the counter 13*b* exceeds a set number, the developing rotary unit 33 is rotated before the development cartridge 37 reaches its use limit (lifetime), the development cartridge 37 is changed over so that the next development cartridge 37 is moved to the developing position facing the photosensitive drum 32 (Step S27). Thereafter, the CPU 13 returns to Step S23, the development cartridge 37 are changed over for every set number until any unprocessed print command does not exist, to repeat a series of image forming operation, and thereby record and form a monochromatic single color image on one side or both sides of a recording sheet S (Steps S23 to S27).

As thus described, in the present embodiment, similar to the above embodiment, since the development cartridges 37 are repeatedly changed over whenever the CPU 13 receives a print command during standby status or the integrated number of developed images exceeds a set number (without continuing to use the development cartridges up to their usable limit (lifetime)), in the case in which the development cartridges 37 containing the same color toners are set in the developing rotary unit 33, developing rollers 37*b* and supply rollers 37*c* of the respective development cartridges 37 can be rotated one after another, and thus the positions of mutual pressure contact therebetween can be changed. Accordingly, continuous image forming can be realized for a prolonged period of time without necessitating replacing the development cartridges 37 for every runout of toners, and the period for which the developing rollers 37*b* and the supply rollers 37*c* are pressure-contacted with each other at the same place can be shortened as much as possible compared as conventional image forming apparatuses. As a result, high-quality image forming can be performed without occurrence of so-called leaving banding.

Next, FIG. 9 shows changeover control of developing cartridges in a printer being one embodiment of an image forming apparatus according to a third embodiment of the present invention. In addition, since the present embodiment is configured substantially similar to the above described embodiments, the same parts are denoted by the same reference numerals and the characterizing portions will be described with reference to the drawings referred to in the embodiments.

In this embodiment, in a case that the CPU 13 determines that the development cartridges 37 containing the same color toners are mounted in all the accommodating spaces 41*y*, 41*m*, 41*c* and 41*k* of the developing rotary unit 33, when an image forming operation (a developing operation) based on a previous print (image forming) command is completed and shifted to a standby status, and then another image forming operation based on the next print command is performed (only when a development cartridge 37 receives the next image operation command at a discontinuous image operation time), a previously used development cartridge 37 is changed over to the next development cartridge 37. As a result, the CPU 13 executes the image forming control while operating the set development cartridges 37 as equally as possible, thereby recording and forming a monochromatic image according to the image data sent from the control part 11 on one side or both sides of the recording sheet S.

Specifically, for example, if development cartridges 37 which contain a black (K) toner are mounted in all the accommodating spaces 41*y* and 41*k* of the developing rotary unit 33 to form a black-and-white monochromatic image because documents, etc. are often printed, the CPU 13, as shown in a flowchart of FIG. 9, executes an image forming control including the changeover control of the development cartridge 37 based on whether a development cartridge is operated previously.

First, when a print command of image data of a monochromatic image from the control part 11 is received (Step S31), it is checked whether or not a last (previously) used development cartridge 37 is located at a developing position facing the photosensitive drum 32 (Step S32). If the last used development cartridge remains at the developing position, the developing rotary unit 33 is rotated to change over the development cartridge 37 at the developing position (Step S33). For example, when the developing operation according to a last print command is being performed by the development cartridge 37 mounted in the accommodating space 41*c*, in a case in which the development cartridges 37 in the other accommodating spaces 41*y*, 41*m*, and 41*k* stands by at the developing position, Step S34 is carried out while other intermediate steps are skipped. On the other hand, if the development cartridge 37 in the accommodating space 41*c* stands by at the developing position facing the photosensitive drum 32, the development cartridge 37 in the next accommodating space 41*k* is moved to the developing position facing the photosensitive drum 32, so that the development cartridge 37 to be used is changed over. Next, the drive control of the sheet conveying unit 20 or image recording unit 30 for printing received image data is executed to record and form the data on one side or both sides of the recording sheet S (Step S34).

By the above processes, when the CPU 13 receives a print command at the time of standby, in the development cartridge 37, the developing operation which drivingly rotates the developing roller 37*b* and the supply roller 37*c* is started after a changeover operation of the development cartridge 37 which rotates the developing rotary unit 33 as long as the development cartridge 37 is not changed over to other one by a replacement work thereof. Accordingly, the position of pressure contact between the developing roller 37*b* and supply roller 37*c* of the development cartridge 37 can be changed sequentially whenever a development cartridge 37 receives a print command at least after its standby. As a result, a trace of pressure contact with the supply roller 37*c* can be effectively prevented from leaving on the surface of the developing roller 37*b*.

Next, the CPU 13 confirms whether or not there is a next print command (an unprocessed print command) (step S35). If there is no unprocessed print command, the CPU 13 stops the image forming control. However, if there is any unprocessed image command, the CPU 13 returns to Step S34 to continue printing (developing) of the image data by the same development cartridge 37, to repeat forming of an image onto the recording sheet S (Steps S34 and S35). As a result, the next print command can be continuously processed without performing the changeover operation of the development cartridges 37, and further the completion time of the image forming processing is not delayed.

In addition, in a case in which two or three development cartridges 37 which contain the same color toners can be mounted in two or three of the accommodating spaces 41*y*, 41*m*, 41*c* and 41*k* of the developing rotary unit 33, similarly, whenever print commands are received, the developing rotary unit 33 is rotated to change over the development cartridge 37 to face the photosensitive drum 32. As a result, high-quality image forming can be performed without occurrence of so-called leaving banding (this is true of embodiments which will be described later).

As described above, in the present embodiment, in the case in which the development cartridges 37 containing the same color toners are set in the developing rotary unit 33, the development cartridges 37 are repeatedly changed over whenever a print command is received during standby status. Thus, the developing rollers 37*b* and the supply rollers 37*c* of the respective development cartridges 37 can be rotated one after another, and the positions of mutual pressure contact between the developing rollers and the supply rollers can be changed. Accordingly, continuous image forming can be realized for a prolonged period of time without necessitating replacing the development cartridges 37 for every runout of toners, and the period for which the developing rollers 37*b* and the supply rollers 37*c* are pressure-contacted with each other at the same place can be shortened as much as possible compared as conventional image forming apparatuses. As a result, high-quality image forming can be performed without occurrence of so-called leaving banding.

Figure 10:
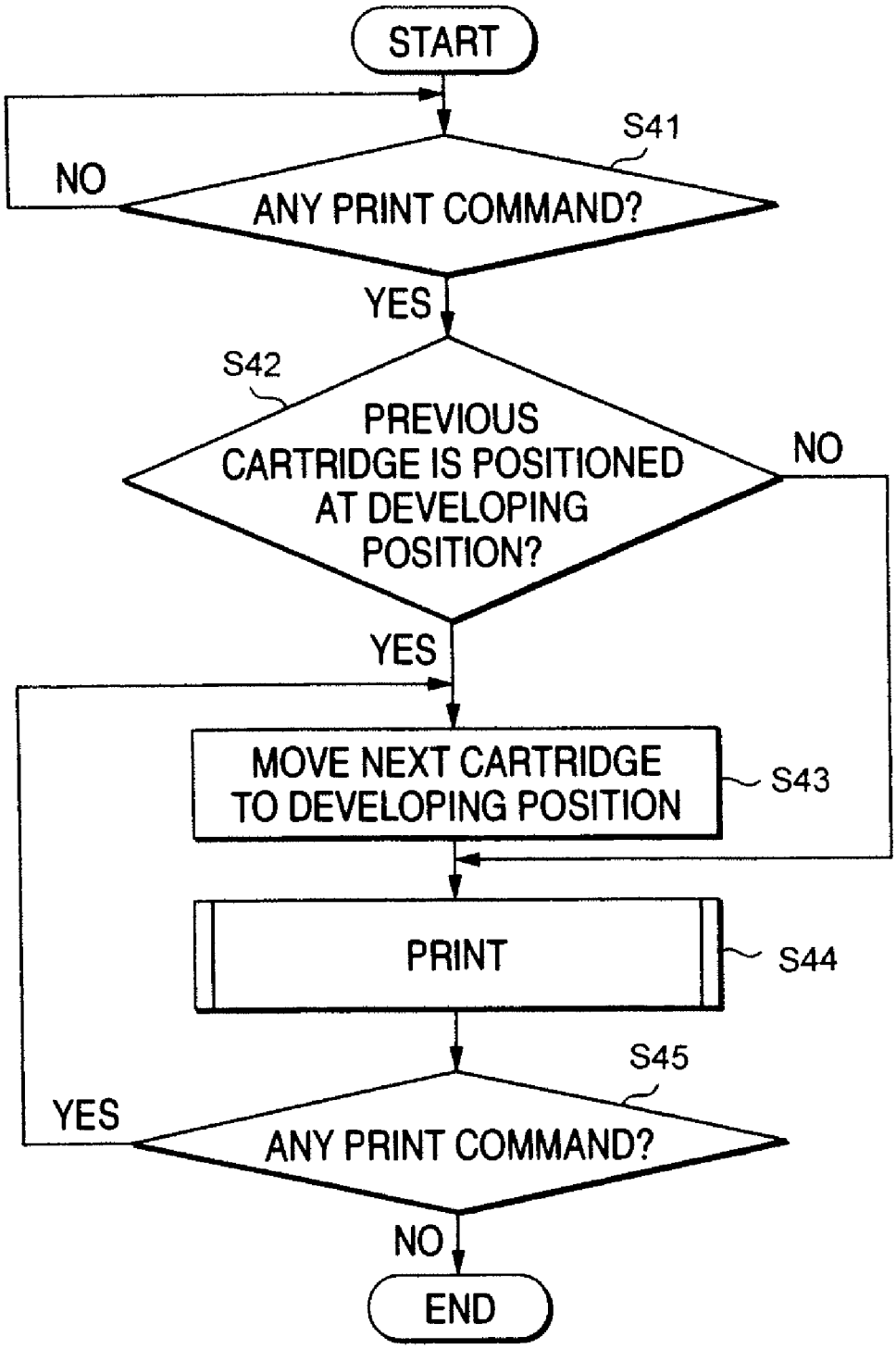
FIG. 10 is a flowchart of an example of a printer to which an image forming apparatus according to a fourth embodiment of the present invention is applied, which illustrates the changeover control of developing cartridges.

Next, FIG. 10 shows changeover control of developing cartridges a printer being one example of an image forming apparatus according to a fourth embodiment of the present invention. In addition, since the present embodiment is configured substantially similar to the above-described embodiments, the same parts are denoted by the same reference numerals and the characterizing portions will be described with reference to the drawings.

In FIG. 2, in a case that the development cartridges 37 which contain, for example, black (K) toners are mounted in all the accommodating spaces 41*y*, 41*m*, 41*c* and 41*k* of the developing rotary unit 33 to form a black-and-white monochromatic image, the CPU 13 of the engine control part 12 in this embodiment, as shown in a flowchart of FIG. 10, when an image forming operation (a developing operation) based on a previous print (image forming) command is completed, and then another image forming operation based on the next print command is performed, a previously used development cartridge 37 is changed over to the next development cartridge 37. That is, the CPU 13 changes over the development cartridges 37 at a timing at which the development cartridges 37 continues image developing, even when the next print command is received. As a result, the CPU 13 executes the image forming control while operating the set development cartridges 37 as equally as possible, thereby recording and forming a monochromatic image according to the image data sent from the control part 11 on one side or both sides of the recording sheet S.

First, similar to the above described embodiments, when a print command is received from the control part 11 (S41), a development cartridge 37 at the developing position facing the photosensitive drum 32 is checked (Step S42), and the next development cartridge 37 is located at the developing position to change over the development cartridges (Step S43). Next, the drive control of the sheet conveying unit 20 or image recording unit 30 for printing received image data is executed to record and form the data on one side or both sides of the recording sheet S (Step S44).

Next, the CPU 13 confirms whether or not there is a next print command (an unprocessed print command) (step S45). If there is no unprocessed print command, the CPU 13 stops the image forming control. However, if there is any unprocessed image command, the CPU 13 returns to Step S43 to locate the next developing cartridge 37 at the developing position and continue printing (developing) of the image data based on the next print command, to repeat forming of an image onto the recording sheet S (Steps S43 to S45).

By the above processes, when the CPU 13 receives a print command without standing by a standby status, in the development cartridge 37, the developing operation which drivingly rotates the developing roller 37*b* and the supply roller 37*c* is started after a changeover operation of the development cartridge 37 which rotates the developing rotary unit 33. Accordingly, the position of pressure contact between the developing roller 37*b* and supply roller 37*c* of the development cartridge 37 can be changed sequentially (shorter than the period of time of pressure-contact in the related art) whenever a development cartridge 37 receives a print command irrespective of whether it is at the time of standby. As a result, a trace of pressure contact with the supply roller 37*c* can be effectively prevented from leaving on the surface of the developing roller 37*b*.

As described above, in the present embodiment, in the case in which the development cartridges 37 containing the same color toners are set in the developing rotary unit 33, the development cartridges 37 are repeatedly changed over whenever a print command is received. Thus, the developing rollers 37*b* and the supply rollers 37*c* of the respective development cartridges 37 can be rotated one after another, and the positions of mutual pressure contact between the developing rollers and the supply rollers can be changed. Accordingly, continuous image forming can be realized for a prolonged period of time without necessitating replacing the development cartridges 37 for every runout of toners, and the period for which the developing rollers 37*b* and the supply rollers 37*c* are pressure-contacted with each other at the same place can be shortened as much as possible. As a result, high-quality image forming can be performed without occurrence of so-called leaving banding.

Figure 11:
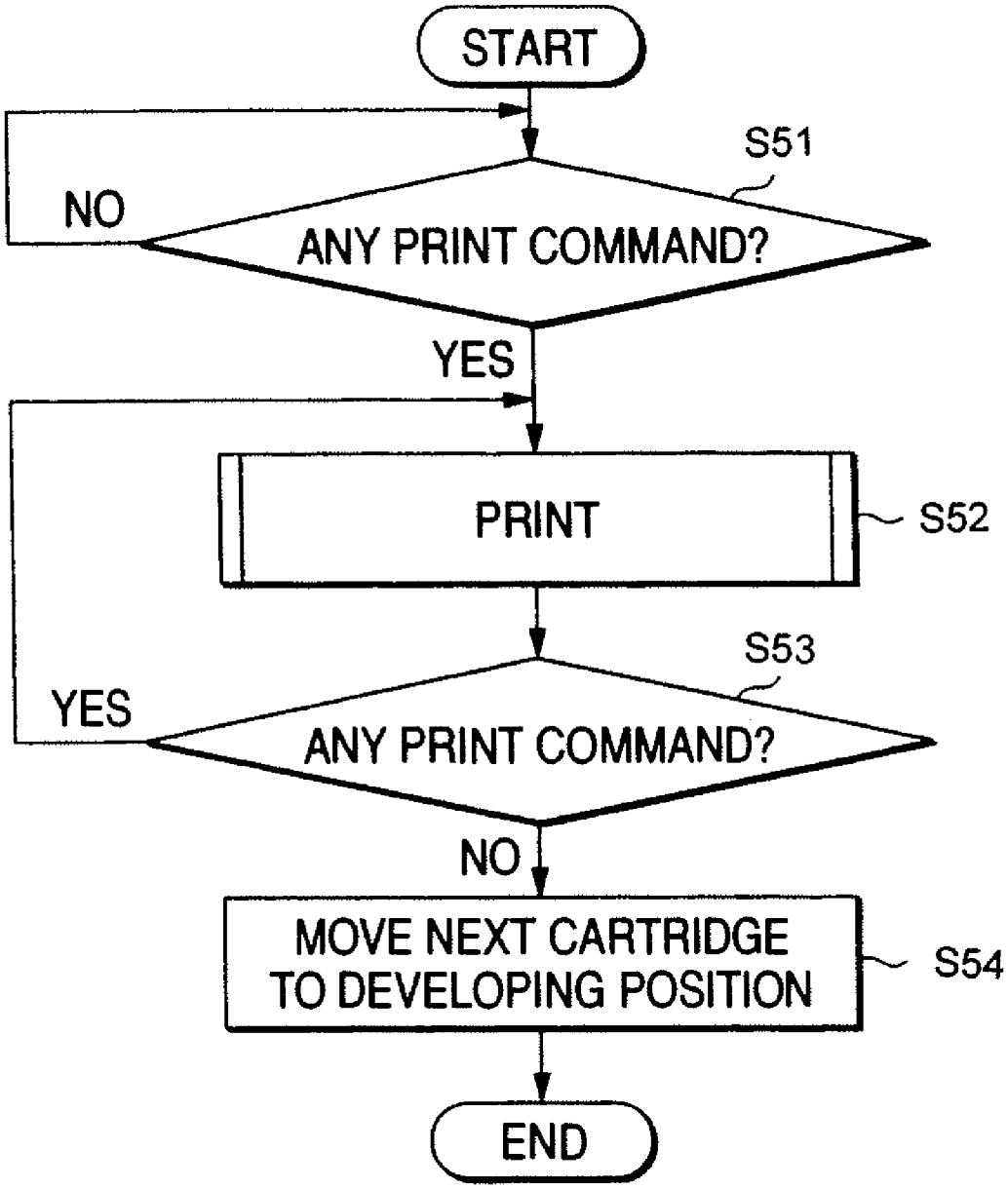
FIG. 11 is a flowchart of an example of a printer to which an image forming apparatus according to a fifth embodiment of the present invention is applied, which illustrates the changeover control of developing cartridges.

Next, FIG. 11 shows changeover control of developing cartridges in a printer being one example of an image forming apparatus according to a fifth embodiment of the present invention. In addition, since the present embodiment is also configured substantially similar to the above described embodiments, the same parts are denoted by the same reference numerals and the characterizing portions will be described with reference to the drawings referred to in the fifth embodiment.

In FIG. 2, the CPU 13 of the engine control part 12 in the third and fourth embodiments controls the developing rotary unit 33 to be rotated to change over the development cartridge 37, using a print command as a trigger. However, the CPU 13 of the engine control part 12 controls to the developing rotary unit 33 to be rotated to change over the development cartridge 37 facing the photosensitive drum 32 after the image forming operation by the previous print command is completed (or before the CPU 13 proceeds to the standby status).

Specifically, in a case that the development cartridges 37 which contain, for example, a black (K) toner are mounted in all the accommodating spaces 41*y*, 41*m*, 41*c* and 41*k* of the developing rotary unit 33 to form a black-and-white monochromatic image, the CPU 13, as shown in a flowchart of FIG. 11, when an image forming operation (a developing operation) based on a print (image forming) command is completed, and subsequently changes over a development cartridge 37 to be used to the next development cartridge 37. As a result, the CPU 13 executes the image forming control while operating the set development cartridges 37 as equally as possible, thereby recording and forming a monochromatic image according to the image data sent from the control part 11 on one side or both sides of the recording sheet S.

First, similar to the above-described embodiments, when a print command is received from the control part 11 (Step S51), the drive control of the sheet conveying unit 20 and the image recording unit 30 for printing received data is executed to form an image on one side or both sides of the recording sheet S (Step S52).

Next, the CPU 13 confirms whether or not there is a next print command (an unprocessed print command) (Step S53). If there is an unprocessed print command, it returns to step S52 to continue printing (developing) of the image data by the same development cartridge 37, to repeat forming of an image onto the recording sheet S (Steps S52 and S53).

On the other hand, if there is no unprocessed print command, a development cartridge 37 at the developing position facing the photosensitive drum 32, changes over to the next development cartridge 37 (step S54) by rotating the developing rotary unit 33, and then the image forming control stops.

By these processes, when the development cartridge 37 receives a print command, the developing operation which drivingly rotates the developing roller 37*b* and the supply roller 37*c* is completed, and subsequently the changeover operation of the development cartridges 37 which rotates the developer rotary unit 33 is performed. Accordingly, the position of pressure contact between the developing roller 37*b* and supply roller 37*c* of the development cartridge 37 can be changed sequentially (shorter than the period of time of pressure-contact in the related art) whenever a development cartridge 37 receives a print command. As a result, a trace of pressure contact with the supply roller 37*c* can be effectively prevented from leaving on the surface of the developing roller 37*b*.

As described above, in the present embodiment, similar to the above-described embodiments, in the case that the development cartridges 37 which contain the same color toner are set in the developing rotary unit 33, the development cartridges 37 are repeatedly changed over whenever they receive print commands. Thus, the developing rollers 37*b* and the supply rollers 37*c* of the respective development cartridges 37 can be rotated one after another, and the positions of mutual pressure contact between the developing rollers and the supply rollers can be changed. Accordingly, continuous image forming can be realized for a prolonged period of time without necessitating replacing the development cartridges 37 for every runout of toners, and the period for which the developing rollers 37*b* and the supply rollers 37*c* are pressure-contacted with each other at the same place can be shortened as much as possible compared as conventional image forming apparatuses. As a result, high-quality image forming can be performed without occurrence of a so-called leaving banding.

In addition, the CPU 13 changes over the development cartridge 37 before it proceeds to the standby status in the present embodiment. However, the present invention is not limited thereto, and the development cartridge 37 at the developing position facing the photosensitive drum 32 may be changed over before the existence or non-existence of a non-processed print command is checked by reversing steps S53 and S54, as in the fourth embodiment.

Figure 12:
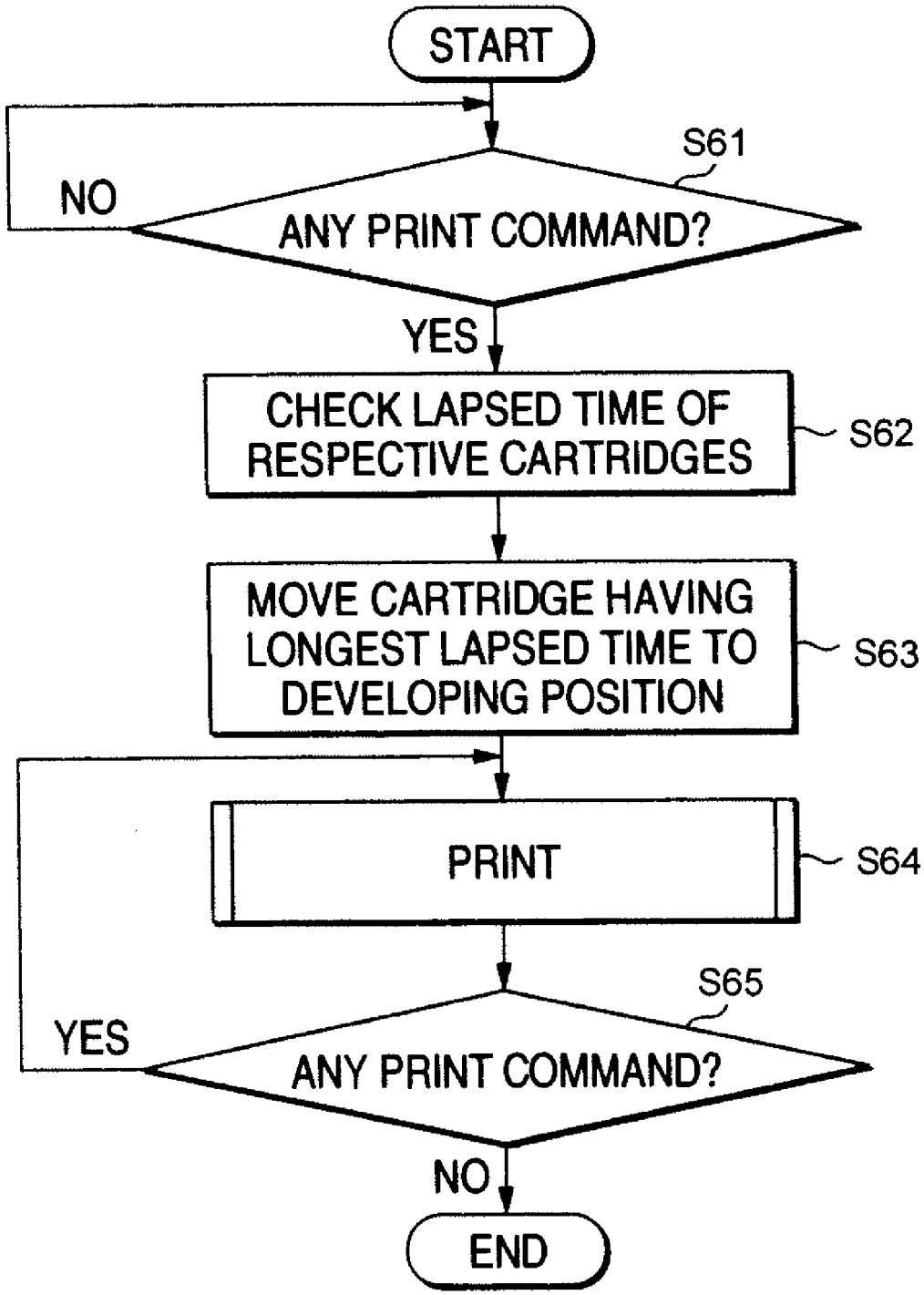
FIG. 12 is a flowchart for explaining the changeover control of the development cartridges according to a seventh embodiment of the invention.

Next, FIG. 12 shows changeover control of developing cartridges in a printer being one embodiment of an image forming apparatus according to a seventh embodiment of the present invention. In addition, since the present embodiment is configured substantially similar to the above described embodiments, the same parts are denoted by the same reference numerals and the characterizing portions will be described with reference to the drawings referred to in the embodiments.

At this time, in a case that the CPU 13 determines that the development cartridges 37 containing the same color toners are mounted in all the accommodating spaces 41*y*, 41*m*, 41*c* and 41*k* of the developing rotary unit 33, the CPU 13 also constructs a clock unit and thereby calculate (clocks) a lapsed time from a point of time when the previous developing operation of the respective development cartridges 37 is finished from the time stored in the main body memory 15 and the time clocked by the timer 13*a*, and then start the next developing operation based on the lapsed time. For example, when the CPU 13 starts the next developing operation from the standby status, it controls a development cartridge 37 having a longest lapsed time from the completion of the previous developing operation to move to the developing position facing the photosensitive drum 32 to change over a development cartridge to be used. As a result, the CPU 13 executes the image forming control while operating the set development cartridges 37 as equally as possible, thereby recording and forming a single color image according to the image data sent from the control part 11 on one side or both sides of the recording sheet S.

Specifically, for example, if development cartridges 37 which contain a black (K) toner are mounted in all the accommodating spaces 41*y* and 41*k* of the developing rotary unit 33 to form a black-and-white monochromatic image because documents, etc. are often printed, the CPU 13, as shown in a flowchart in FIG. 12, executes an image forming control including the changeover control of the development cartridge 37 in accordance with the lapsed time.

First, if the CPU 13 receives a print command of image data of a monochromatic image from the control part 11 (Step S61), it reads out the completion time of the (just) previous developing operation written in the main body memory 15 of the respective development cartridge 37 (Step S62), receives the present time clocked by the timer 13*a*, calculates and checks the lapsed time from the completion of a developing operation for every development cartridge 37 (Step S62, and rotates the developing rotary unit 33 to change over the development cartridges 37 so that a development cartridge 37 having the longest elapsed time is moved to the developing position (Step S63). For example, if the development cartridge 37 mounted in the accommodating space 41*c* stands by at the developing position facing the photosensitive drum 32, but the lapsed time of a development cartridge 37 mounted in the next accommodating space 41*k* is the longest, the development cartridge 37 in the accommodating space 41*k* is moved to the developing position, thereby changing over the development cartridge 37 to be used. In addition, if the lapsed time of a development cartridge 37 except for that in the next accommodating space 41*k* is the longest due to a certain reason, such as the replacement of development cartridges 37, the development cartridge 37 is moved to the developing position facing the photosensitive drum 32 to change over the development cartridge 37 to be used.

By the above processes, when the CPU 13 receives a print command at the time of standby, the developing rotary unit 33 is rotated to change over the existing development cartridge 37 to a development cartridge 37 having the longest lapsed time from the completion of the previous developing operation, that is, having the longest stopping time, and then the developing operation which drivingly rotates the developing roller 37*b* and the supply roller 37*c* which have stopped is started. Accordingly, the position of pressure contact between the developing roller 37*b* and supply roller 37*c* of the development cartridge 37 having the longest stopping time can be changed sequentially whenever a print command is receive. As a result, a trace of pressure contact with the supply roller 37*c* can be effectively prevented from leaving on the surface of the developing roller 37*b* by operating the developing rotary unit 37 at a shorter period than the period of pressure contact in the related art.

Thereafter, the drive control of the sheet conveying unit 20 or image recording unit 30 for printing received image data is executed to record and form the data on one side or both sides of the recording sheet S (Step S64). Next, the CPU 13 confirms whether or not there is a next print command (an unprocessed print command) (Step S65). If there is no unprocessed print command, the CPU 13 rewrites the completion time of the developing operation of the used development cartridge 37 stored in the main body memory 15 with the present time clocked by the timer 13*a*, and then stops the image forming control. On the other hand, if there is an unprocessed print command, the CPU 13 returns to Step S64 to continue printing (developing) image data by the same development cartridge 37, and to repeat the forming of an image onto the recording sheet S (Steps S64 and S65).

In addition, in a case in which two or three development cartridges 37 which contain the same color toners can be mounted in two or three of the accommodating spaces 41*y*, 41*m*, 41*c* and 41*k* of the developing rotary unit 33, similarly, whenever print commands are received, the developing rotary unit 33 is rotated to change over the development cartridge 37 to face the photosensitive drum 32. As a result, high-quality image forming can be performed without occurrence of so-called leaving banding (this is true of embodiments which will be described later).

As described above, in the present embodiment, in the case in which the development cartridges 37 which contain the same color toners are set in the developing rotary unit 33, the existing development cartridge is changed over to a development cartridges 37 having the longest stopping time whenever a print command is received during standby status. Thus, the developing rollers 37*b* and the supply rollers 37*c*, having long period of pressure contact, of the development cartridges 37 can be preferentially rotated, and the positions of mutual pressure contact therebetween can be changed. Accordingly, continuous image forming can be realized for a prolonged period of time without necessitating replacing the development cartridges 37 for every runout of toners, and the period for which the developing rollers 37*b* and the supply rollers 37*c* are pressure-contacted with each other at the same place can be shortened as much as possible compared as conventional image forming apparatuses. As a result, high-quality image forming can be performed without occurrence of a so-called leaving banding.

Figure 13:
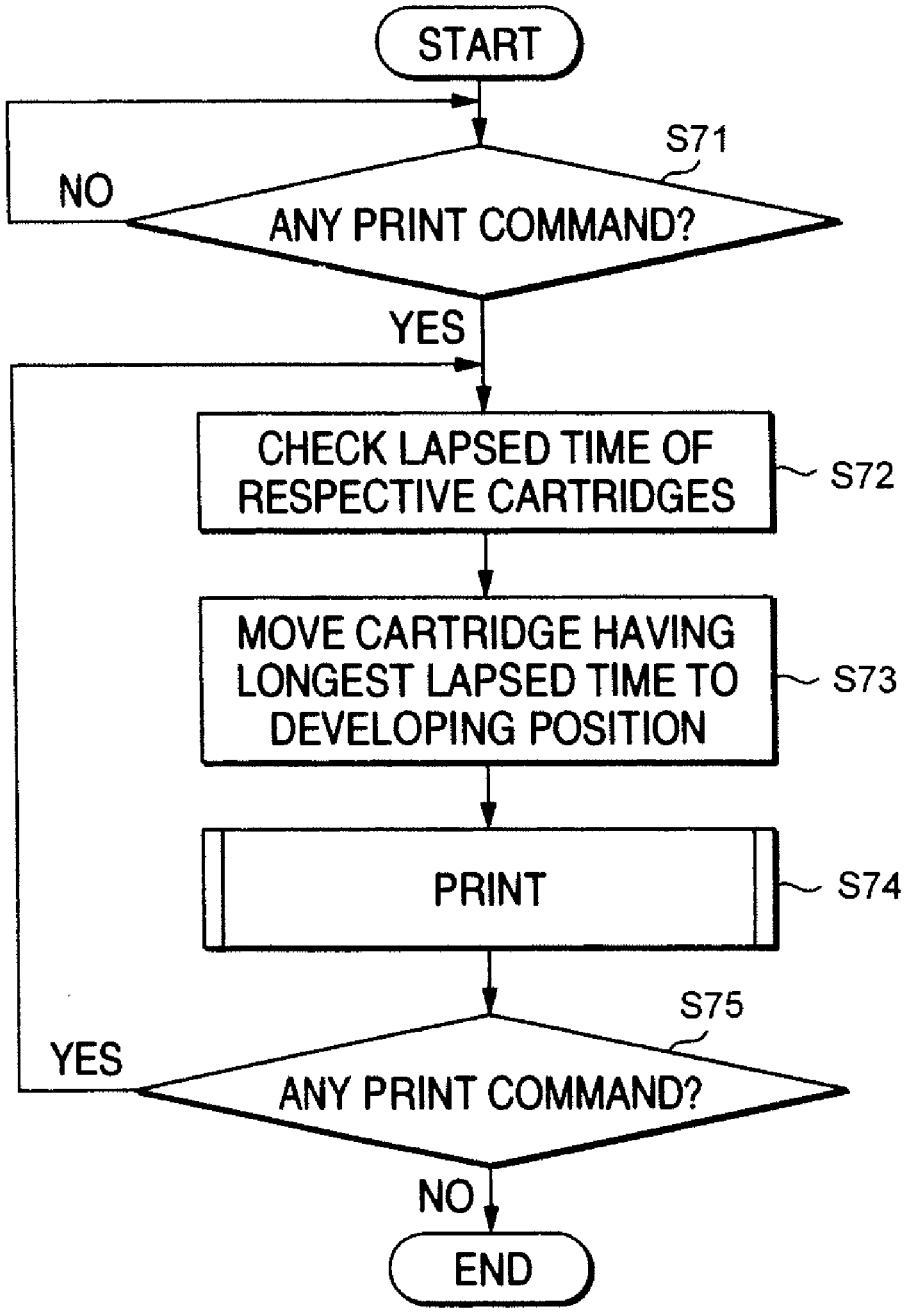
FIG. 13 is a flowchart of an example of a printer to which an image forming apparatus according to a eighth embodiment of the present invention is applied, which illustrates the changeover control of developing cartridges.

Next, FIG. 13 shows changeover control in developing cartridges an example of a printer to which an image forming apparatus according to a eighth embodiment of the present invention is applied. In addition, since the present embodiment is configured substantially similar to the above described embodiments, the same parts are denoted by the same reference numerals and the characterizing portions will be described with reference to the drawings referred to in the first embodiment.

In FIG. 2, in a case that the development cartridges 37 which contain, for example, a black (K) toner are mounted in all the accommodating spaces 41*y*, 41*m*, 41*c* and 41*k* of the developing rotary unit 33 to form a black-and-white monochromatic image, the CPU 13 of the engine control part 12 in this embodiment, as shown in a flowchart of FIG. 13, when an image forming operation (a developing operation) based on a previous print (image forming) command is completed, and then another image forming operation based on the next print command is performed, the existing development cartridge 37 is changed over to a development cartridge 37 having the longest stopping time. That is, the CPU 13 changes over the development cartridges 37 at a timing at which the development cartridges 37 continues image developing, even when the next print command is received. As a result, the CPU 13 executes the image forming control while operating the set development cartridges 37 as equally as possible, thereby recording and forming a monochromatic image according to the image data sent from the control part 11 on one side or both sides of the recording sheet S.

First, similar to the above-described embodiments, when a print command is received from the control part 11 (Step S71), the lapsed time from the completion of the developing operation of the respective development cartridges 37 is calculated and checked (Step S72), and a development cartridge 37 having the longest lapsed time is moved to the developing position to change over the development cartridges 37 (Step S73). Thereafter, the drive control of the sheet conveying unit 20 or image recording unit 30 for printing received image data is executed to record and form the data on one side or both sides of the recording sheet S (Step S74).

Next, the CPU 13 confirms whether or not there is a next print command (an unprocessed print command) (Step S75). If there is no unprocessed print command, the CPU 13 rewrites the finish time of the developing operation of the used development cartridge 37 stored in the main body memory 15 with the present time, and then stops the image forming control. On the other hand, if there is an unprocessed print command, the CPU 13 returns to Step S72 to change over the existing development cartridge to a development cartridge 37 having the next longest lapsed time (the longest lapsed time at present time), and then continue printing (developing) image data to repeat the forming of an image onto the recording sheet S (Steps S72 to S75).

By the above processes, when the CPU 13 receives a print command without waiting a standby status, in the development cartridge 37, the developing operation which drivingly rotates the developing roller 37*b* and the supply roller 37*c* is started after the developing rotary unit 33 is rotated to change over the existing development cartridge to a development cartridge 37 having the longest stopping time. Accordingly, the position of pressure contact between the developing roller 37*b* and supply roller 37*c* of the development cartridge 37 can be changed sequentially (shorter than the period of pressure contact in the related art) whenever a development cartridge 37 receives a print command irrespective of standby time. As a result, a trace of pressure contact with the supply roller 37*c* can be effectively prevented from leaving on the surface of the developing roller 37*b*.

As described above, in the present embodiment, similar to the above-described embodiments, in the case in which the development cartridges 37 containing the same color toners are set in the developing rotary unit 33, the existing development cartridge is changed over to a development cartridge 37 having the longest stopping time whenever a print command is received. Thus, the developing rollers 37*b* and the supply rollers 37*c*, having the long period of pressure contact, of the respective development cartridges 37 can be preferentially, and frequently rotated one after another, and the positions of mutual pressure contact between the developing rollers and the supply rollers can be changed. Accordingly, continuous image forming can be realized for a prolonged period of time without necessitating replacing the development cartridges 37 for every runout of toners, and the period for which the developing rollers 37*b* and the supply rollers 37*c* are pressure-contacted with each other at the same place can be shortened as much as possible. As a result, high-quality image forming can be performed without occurrence of so-called leaving banding.

Here, in the above seventh and eighth embodiments, the CPU 13 controls the developing rotary unit 33 to be rotated to change over the development cartridge 37, using a print command as a trigger before executing an image forming operation. However, the present invention is not limited thereto, and the CPU 13 may control the developing rotary unit 33 to be rotated to change over the development cartridge 37 after the image forming operation by the previous print command is completed (or before the CPU 13 proceeds to the standby status).

Although the above-described embodiments have been described with respect to a rotary-type image forming apparatus in which the developing rotary unit 33 capable of accommodating the plurality of development cartridges 37 is rotated to change over a development cartridge 37 to face the photosensitive drum 32, the present invention is not limited thereto, and can be applied to, for example, a tandem-type image forming apparatus.

Figure 14:
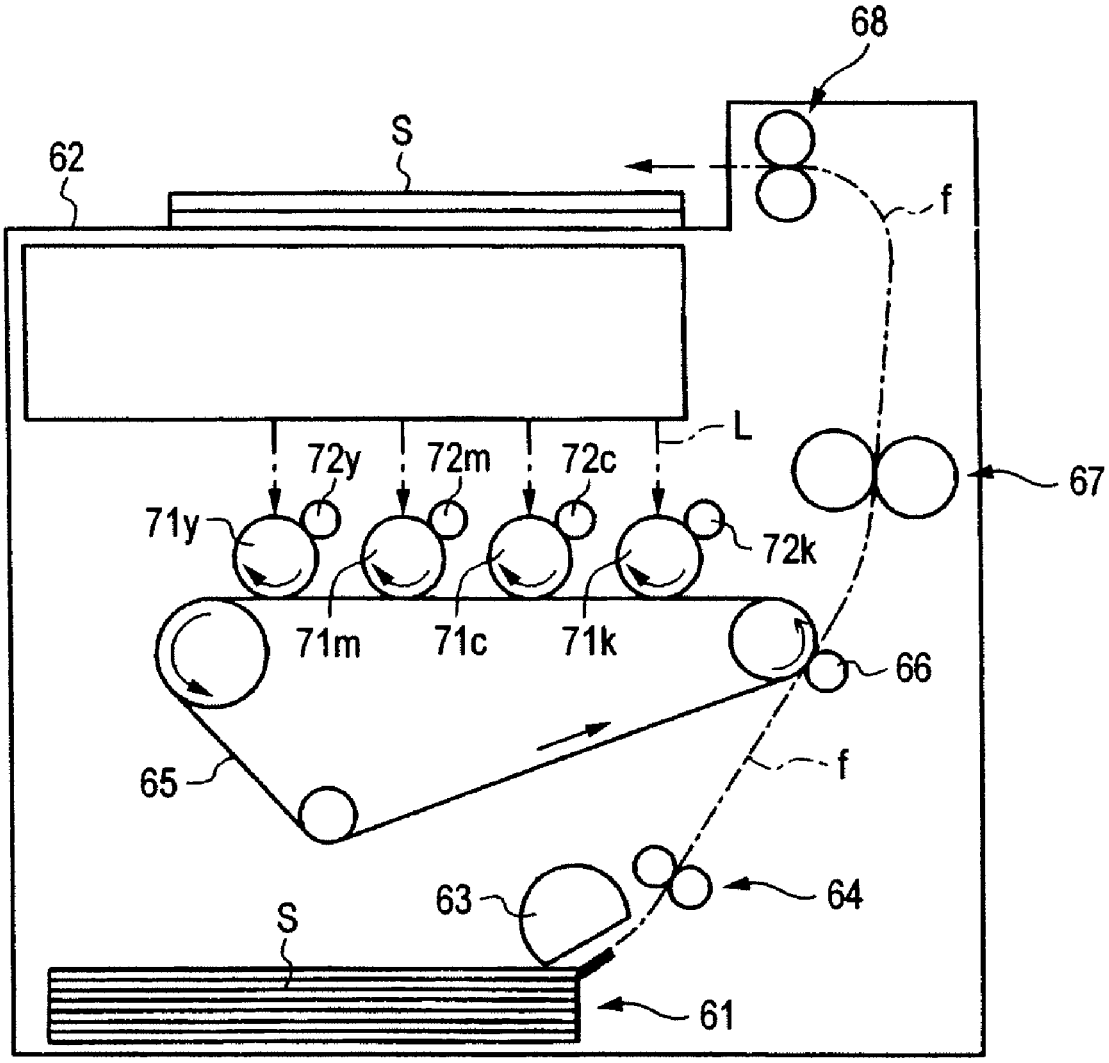
FIG. 14 is a perspective front view illustrating an image forming apparatus to which the first through eleventh embodiments are applied.

That is, in the tandem-type image forming apparatus, for example, as shown in FIG. 14, a pickup roller 63, a pair of conveying rollers 64, an intermediate transfer belt 65, a transfer rollers 66, a pair of fixing rollers 67 and a pair of sheet discharge rollers 68 are arranged in a conveying path f from the sheet cassette 61 to the sheet discharge table 62, similar to the above-described embodiments, and a toner image formed on the surface of the intermediate transfer belt 65 is transferred on one side of the recording sheet S which passes through the conveying path f, and is fixed thereon, thereby forming an image.

In the tandem-type intermediate transfer belt 65, a set of a photosensitive drum and a development cartridge for each color of yellow (Y), magenta (M), cyan (C) and black (K), which formed a color image, are juxtaposed in a transfer direction of the belt. Development cartridges which contain the same color toners or different color toners are respectively disposed in these separate photosensitive drums 71*y*, 71*m*, 71*c* and 71*k*, and a toner image of a color image, a multi-color image, or a monochromatic image is formed by respective developing rollers 72*y*, 72*m*, 72*c* and 72*k*.

Thus, in a case that the development cartridges which contain the same color toners are mounted, the photosensitive drums 71*y*, 71*m*, 71*c* and 71*k* and the developing rollers 72*y*, 72*m*, 72*c* and 72*k* are individually operated, and their driving are controlled so that the drums and rollers other than a drum and a roller which are operating are stopped. Here, in individually operating the developing rollers 72*y*, 72*m*, 72*c* and 72*k*, separate drive motors may be disposed, or an electromagnetic clutch, etc. may be placed in a transmission path of a driving force.

From the foregoing, the tandem-type image forming apparatus is also constructed similar to the above embodiments such that the development cartridges to be operated are repeatedly changed over whenever the CPU 13 receives a print command during standby status or the integrated operation time or number of developed images exceeds a set value (a set time or a set number), in addition to realizing prolonged image forming without replacing a development cartridge for every runout of toner. As a result, high-quality image forming can be performed without occurrence of so-called leaving banding.

In addition, whenever print commands are received, development cartridges to be operated can be repeatedly changed over to rotate the developing rollers of the respective development cartridges one after another. As a result, high-quality image forming can be performed without occurrence of a leaving banding.

In addition, whenever print commands are received, development cartridges to be operated can be repeatedly changed over to rotate the developing rollers of the respective development cartridges one after another. As a result, high-quality image forming can be performed without occurrence of a leaving banding.

Figure 15:
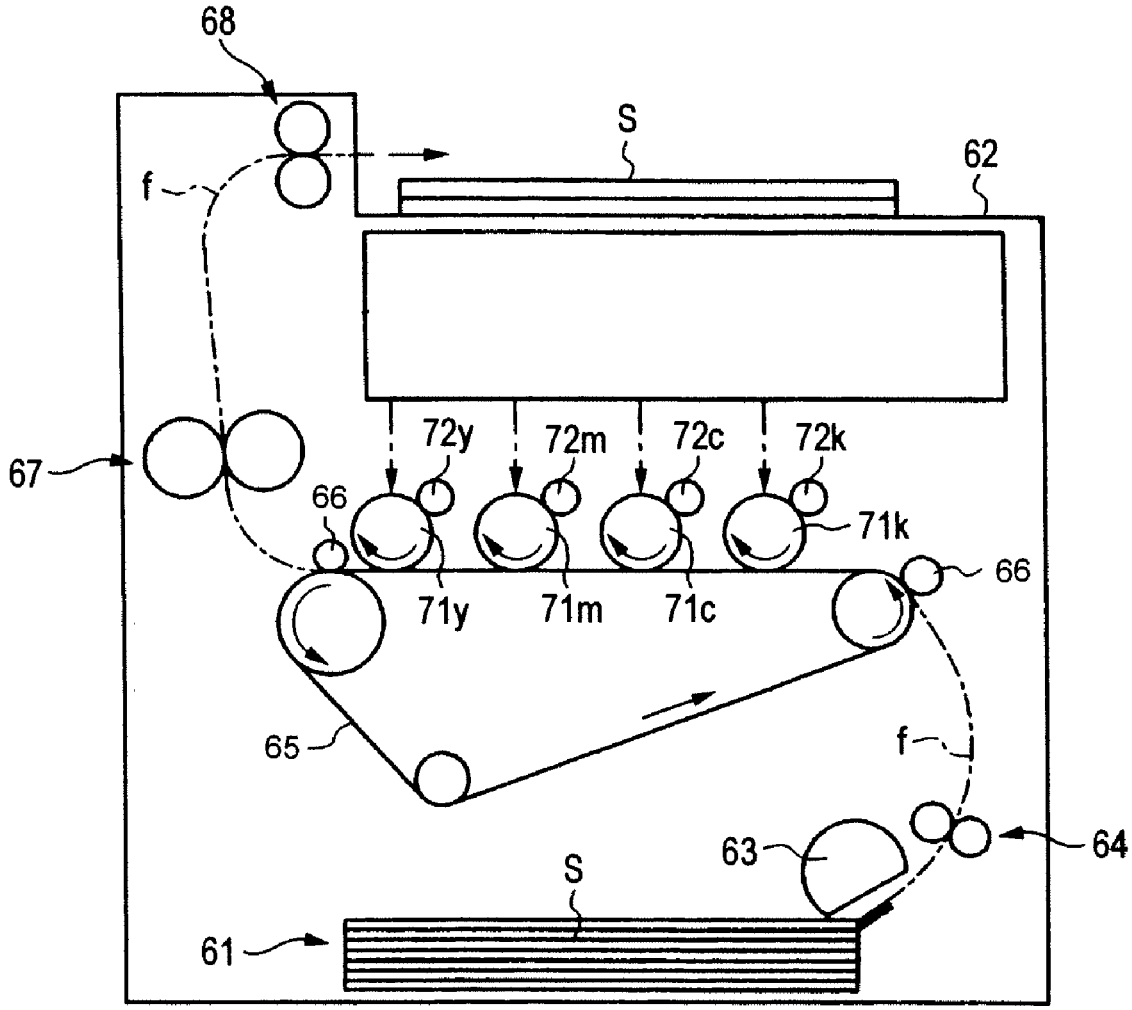
FIG. 15 is a perspective front view illustrating an image forming apparatus to which the first through eleventh embodiments are applied.

Further, the application of the above embodiments is not limited to an image forming apparatus of type employing an intermediate transfer belt. For example, as shown in FIG. 15, the above embodiments can be applied to an image forming apparatus in which a toner image is directly transferred to and fixed on a recording sheet S which is conveyed through a conveying path f.

That is, in the image forming apparatus, the conveying belt 65 and the conveying roller 66 are arranged instead of the intermediate transfer belt 55 and the transfer roller 56, so that a toner image of a developed color image, multi-color image or monochromatic image is transferred onto a recording sheet S and fixed thereon while the recording sheet S is pinched and conveyed between the conveying roller 66 and the conveying belt 65, and between the conveying belt 65 and the photosensitive drum 71*y*, 71*m*, 71*c* and 71*k*.

Thus, in a case in which development cartridges which contain the same color toners are mounted, the photosensitive drums 71*y*, 71*m*, 71*c* and 71*k* and the developing rollers 72*y*, 72*m*, 72*c* and 72*k* are individually operated, and their driving are controlled so that the drums and rollers other than a drum and a roller which are operating are stopped.

From the foregoing, such a direct-transfer-type image forming apparatus is also constructed similar to the above embodiments such that the development cartridges to be operated are repeatedly changed over whenever the CPU receives a print command during standby status or the integrated operation time or number of developed images exceeds a set value (a set time or a set number), in addition to realizing prolonged image forming without replacing a development cartridge for every runout of toner. As a result, high-quality image forming can be performed without occurrence of so-called leaving banding.

Moreover, whether or not the integrated operation time or integrated number of developed images reaches a set value is determined so that the development cartridges continues to be used up to their usable limits (lifetimes) is determined in the above first and second embodiments, but the present invention is not limited thereto. For example, developing rollers of the respective development cartridges are rotated one after another to realize high-quality image forming without occurrence of leaving banding by detecting, for example, a counted value by a toner counter, a dot number of an image, or a actually measured residual amount of a toner to thereby change over development cartridges to be operated whenever the detection value exceeds a set value.

Here, it is needless to say that whether the integrated operation time or the integrated number of developed images reaches a set time is determined the CPU receives a print command, but the print commands may be print commands which are received from the personal computer PC for every job which prints one document (a job which prints a plurality of image data sheets at a time), or print commands which are received for every job (a job which is generated for every page) which is generated in units of pages in the one document.

Also, the image forming can be realized for a prolonged period of time without replacing a development cartridge for every runout of toners. In addition, whenever print commands are received, development cartridges to be operated can be repeatedly changed over to rotate the developing rollers of the respective development cartridges one after another. As a result, high-quality image forming can be performed without occurrence of a leaving banding.

Moreover, it is needless to say that the print commands in the above-described embodiments, may be print commands which are received from the personal computer PC for every job which prints one document (a job which prints a plurality of image data sheets at a time), or print commands which are received for every job (a job which is generated for every page) which is generated in units of pages in the one document.

Also, the image forming apparatus can be realizes prolonged image forming without replacing a development cartridge for every runout of toner. As a result, high-quality image forming can be performed without occurrence of so-called leaving banding.

Moreover, it is needless to say that the print commands in the above-described embodiments, may be print commands which are received from the personal computer PC for every job which prints one document (a job which prints a plurality of image data sheets at a time), or print commands which are received for every job (a job which is generated for every page) which is generated in units of pages in the one document.

Figure 16:
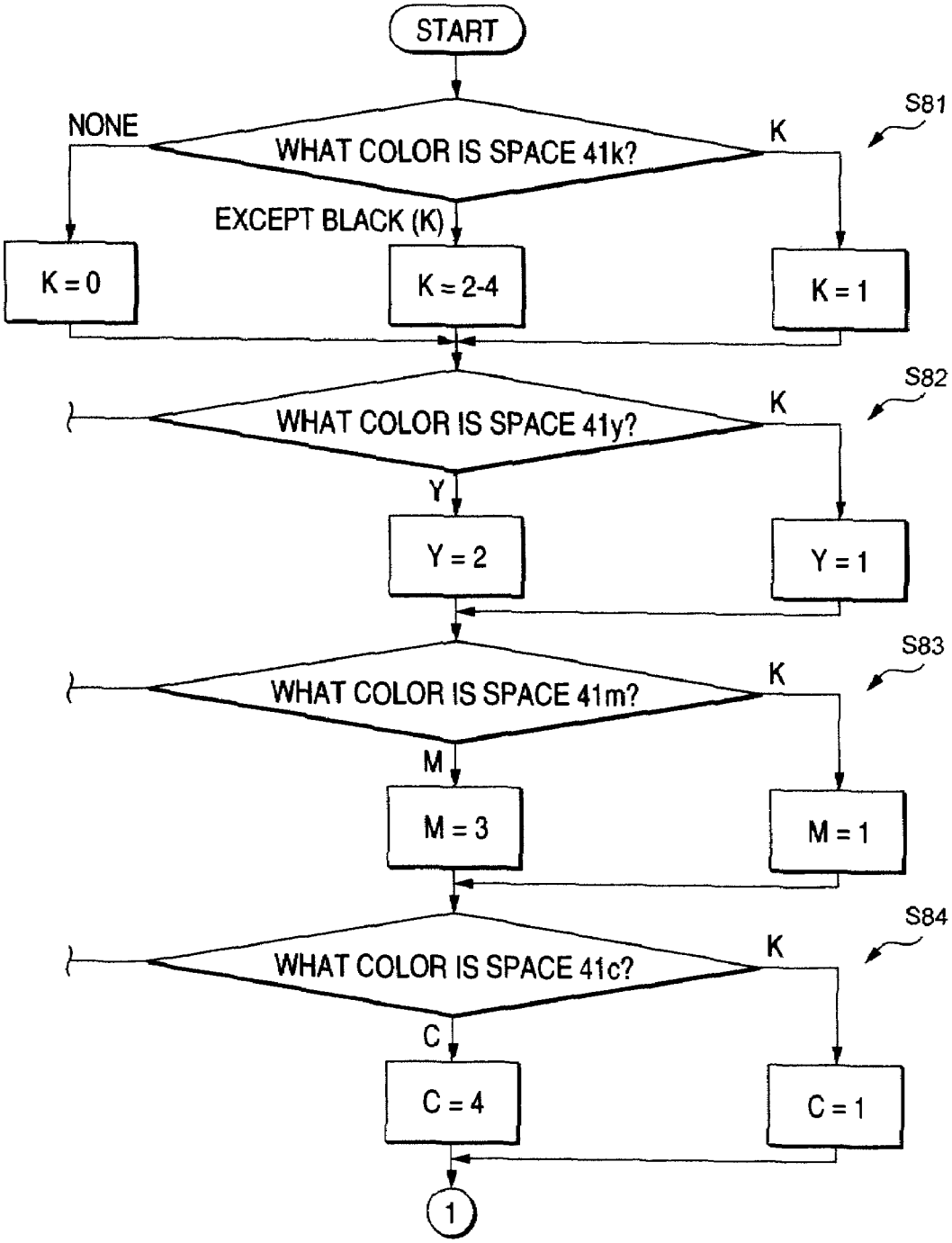
FIG. 16 is a flowchart for explaining the changeover control of the development cartridges according to a ninth embodiment of the invention.

Next, FIG. 16 shows changeover control of developing cartridges in a printer being one example of an image forming apparatus according to a ninth embodiment of the present invention. In addition, since the present embodiment is configured substantially similar to the above described embodiments, the same parts are denoted by the same reference numerals and the characterizing portions will be described with reference to the drawings referred to in the above embodiments.

In this embodiment, as shown in a flowchart of FIG. 16, the CPU 13 confirms the existence or non-existence and color information of toners in the developer cartridges 37 set the accommodating spaces 41*y*, 41*m*, 41*c* and 41*k* of the developing rotary unit 33, and then executes various kinds of image forming control.

First, the CPU 13 confirms the existence or non-existence of a developer cartridge 17 in the accommodating space 41*k* of the developing rotary unit 33, and color information on a toner to be contained, to execute processing which stores and holds in the main body memory 15 (step S81). For example, if any developer cartridge 37 is not accommodated, the CPU 13 writes 'K=0' as identification information in the main body memory 15, whereas if developer cartridges 37 are accommodated, the CPU 13 writes Specifically, the CPU 13 writes, as identification information corresponding to respective colors, 'K=1' in the case of black (B), 'K=2' in the case of yellow (Y), 'K=3' in the case of magenta (M), and 'K=4' in the case of cyan (C) in the main body memory 15. It is noted herein that the present embodiment has been described about a case in which the developer cartridges 37 containing the respective colors are accommodated in the accommodating spaces 41*y*, 41*m*, 41*c* and 41*k* of the developing rotary unit 33 without limitation, but developer cartridges 37 which can be accommodated may be limited. For example, only a developer cartridge 37 which contains a yellow (Y) toner or a black (K) toner may be accommodated in the accommodating space 41*y*.

Next, similarly, the CPU 13 confirms the existence or non-existence of a developer cartridge 17 in the accommodating space 41*y* of the developing rotary unit 33, and color information on a toner to be contained, and then writes non-existence of a developer cartridge 37, or any one of 'Y=0' to 'Y=4' as color information on toners in the main body memory 15 (Step S12).

The CPU 13 also executes confirmation similar to the above for the accommodating spaces 41*m* and 41*c* of the developing rotary unit 33, and writes any one of 'M=0' to 'M=4' or any one of 'C=0' to 'C=4' as color information on toners in the main body memory 15 (Steps S83 and S84).

Figure 17:
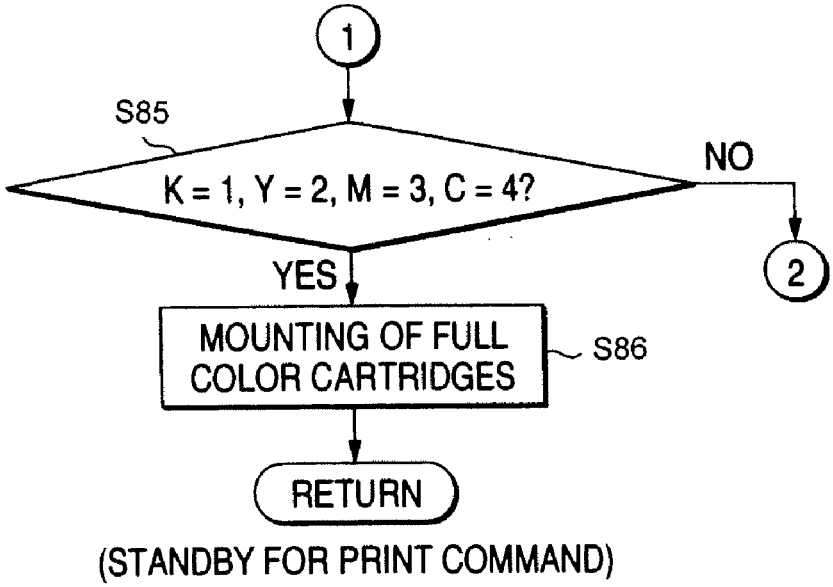
FIG. 17 is a flowchart for explaining the changeover control of the development cartridges subsequent to that in FIG. 16.

Thereafter, the CPU 13 proceeds to a flowchart of FIG. 17. At this time, if the CPU 13 determines that the color information on the developer cartridges 37 held in the main body memory 15 simultaneously satisfies 'K=1', 'Y=1', 'M=1' and 'C=1', it considers the developer cartridges 37 containing the respective color toners of yellow (Y), magenta (M), cyan (C) and black (K) to be respectively mounted in the accommodating spaces 41*y*, 41*m*, 41*c* and 41*k* of the developing rotary unit 33, and selects and executes an image forming control when a full color image is formed (Steps S85 and S86).

In this case, the CPU 13 executes a general image forming control to rotate the developing rotary unit 33 according to the image data sent from the controller part 11, thereby a color image, a multi-color image or a monochromatic image on one side or both sides of the recording sheet S. In other words, whenever the developer cartridges 37 for the respective color toners mounted to the developing rotary unit 33 receive print commands of image data, their positions are appropriately changed over and operated according to kinds of images based on the image data and operate in the changed positions. By this construction, when a color image is formed, developer cartridges 37 in the adjacent accommodating spaces 41*y*, 41*m*, 41*c* and 41*k* can be sequentially moved to the developing position facing the photosensitive drum 32, to thereby execute the image forming control, and an image can be continuously formed on a plurality of recording sheets S without vainly repeating the changeover operation of the developer cartridges 37.

Further, if the color information on the developer cartridges 37 held in the main body memory 15 is not the information that forms a full color image in Step S85 in FIG. 17, the CPU 13 allows an image forming operation to start only when all the developer cartridges 37 mounted within the accommodating spaces 41*y*, 41*m*, 41*c* and 41*k* of the developer cartridges have all the same color.

Figure 18:
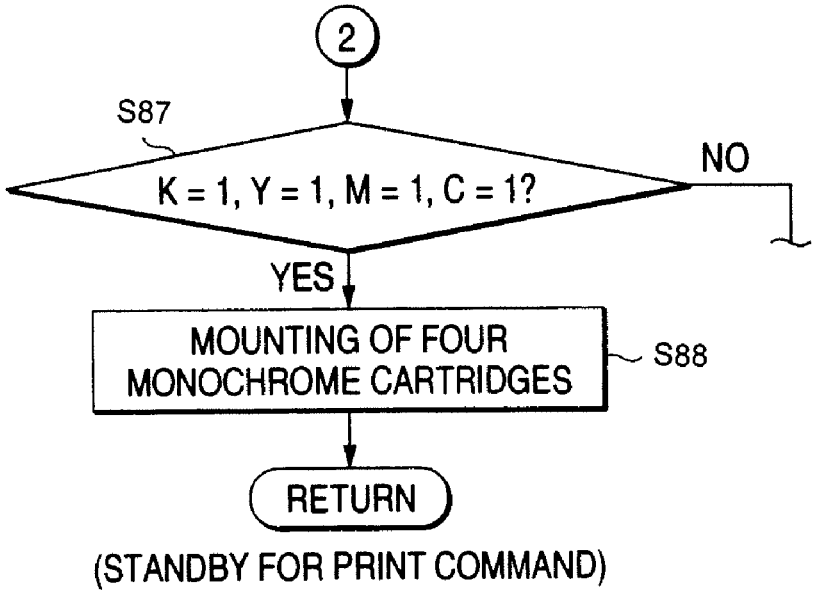
FIG. 18 is a flowchart for explaining the changeover control of developing cartridges subsequent to that in FIG. 17.

For example, the CPU 13 proceeds to a flowchart shown in FIG. 18. At this time, if the CPU 13 determines that the color information on the developer cartridges 37 held in the main body memory 15 simultaneously satisfies 'K=1', 'Y=1', 'M=1' and 'C=1', it selects and executes an image forming control when the four developer cartridges 37 containing the black (K) toner are set in all the accommodating spaces 41*y*, 41*m*, 41*c* and 41*k* of the developing rotary unit 33 so as to be able to continuously form a black-and-white monochromatic image (Steps S87 and S88).

In this case, if the CPU 13 determines that all the developer cartridges 37 have a black (K) toner of the same color, a developer cartridge 37 the rest of lifetime of which is longest is moved to the developing position facing the photosensitive drum 32 on the basis of the information held in the main body memory 15, thereby changing a developer cartridge 37 to be used. By this process, the CPU 13, executes an image forming control while equally operating the set developer cartridges as much as possible, so that a monochromatic image corresponding to the image data sent from the controller part 11 can be recorded and formed on one side or both sides of a recording sheet S. Here, the lifetime of the developer cartridges 37 means that the developer cartridges need to be replaced, for example, means that the runout of a contained toner occurs or a contained toner cannot be frictionally charged any more.

Figure 19:
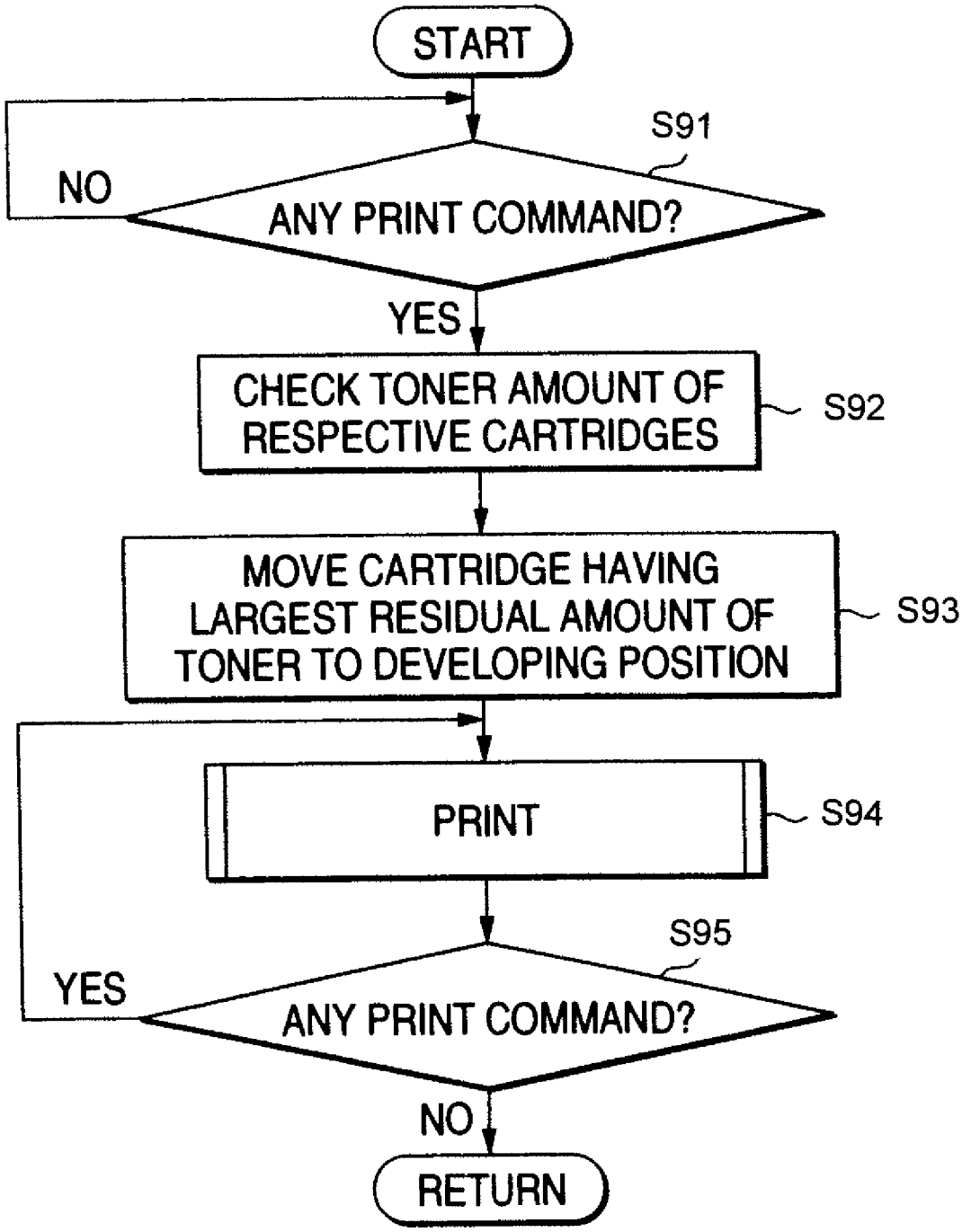
FIG. 19 is a flowchart for explaining the changeover control of developing cartridges subsequent to that in FIG. 18.

Specifically, as shown in a flowchart of FIG. 19, the CPU 13 executes an image forming control including the changeover of the developer cartridges 37 according to the residual amount of contained toners. First, if the CPU 13 is requested of an image forming job from the personal computer PC, and receives a print command of image data of a monochromatic image from the controller part 11 (Step S91), it confirms the residual amount of toners written in the main body memory 15 of the respective developer cartridge 37 (Step S92), and rotates the developing rotary unit 33 to change over the developer cartridges 37 so that a developer cartridge 37 having the largest residual amount of toner is moved to the developing position (Step S93). For example, if the developer cartridge 37 mounted in the accommodating space 41*y* stands by at the developing position facing the photosensitive drum 32, but the rest of lifetime of a developer cartridge 37 mounted in the next accommodating space 41*k* is the longest (the residual amount of a toner is the largest), the developer cartridge 37 in the accommodating space 41*k* is moved to the developing position, thereby changing over the developer cartridge 37 to be used.

Thereafter, the drive control of the sheet conveying unit 20 or image recording unit 30 for printing received image data is executed to record and form the data on one side or both sides of the recording sheet S (Step S94). Next, the CPU 13 confirms whether or not there is a next print command (an unprocessed print command) (Step S95). If there is an unprocessed print command, the CPU 13 rewrites the residual amount of a toner of the used developer cartridge 37 stored in the main body memory 15, and then stops the image forming control. On the other hand, if there is no unprocessed print command, the CPU 13 returns to Step S94 to continue printing (developing) image date by the same developer cartridge 37, and to repeat the forming of an image onto the recording sheet S (Steps S94 and S95).

As a result, when a color image is not formed, developer cartridges 37 containing the same color toners are mounted in all the accommodating spaces 41*y*, 41*m*, 41*c* and 41*k* of the developing rotary unit 33, and an image forming operation only when a printer is used as a machine for exclusive use which forms a monochromatic image) is started. In this case, when the image forming operation starts, a developer cartridge 37 which has the largest residual amount of a toner (the longest rest of lifetime) is preferentially used to average the lifetimes of the developer cartridges 37. As a result, if the toner around the supply roller 37*c* runs out and thus the developer cartridge 37 needs to be replaced after the image forming operation starts, the adjacent developer cartridge 37 can continue performing the image forming operation without the runout of toner.

As thus described, in the present embodiment, only when the developer cartridges 37 containing the same color toners are mounted in all the accommodating spaces 41*y*, 41*m*, 41*c* and 41*k* of the developing rotary unit 33 to thereby continuously form a monochromatic image, a developer cartridge 37 having the longest rest of lifetime is preferentially used to start an image forming operation. Therefore, when the developer cartridges need to be changed over because of the toner runout or the runout of the toner in a toner containing space at the supply roller 37*c*, the period for which the existing developer cartridge is rapidly changed over to the next developer cartridge 37 to continue performing the image forming operation can be prolonged.

Accordingly, because a developer cartridge 37 in which the toner runout does not occur is moved to the developing position, the image forming operation can be rapidly repeated without repeating the rotational operation of the developing rotary unit 33, and a monochromatic image can be continuously formed to finish the image forming operation without stress.

Figure 20:
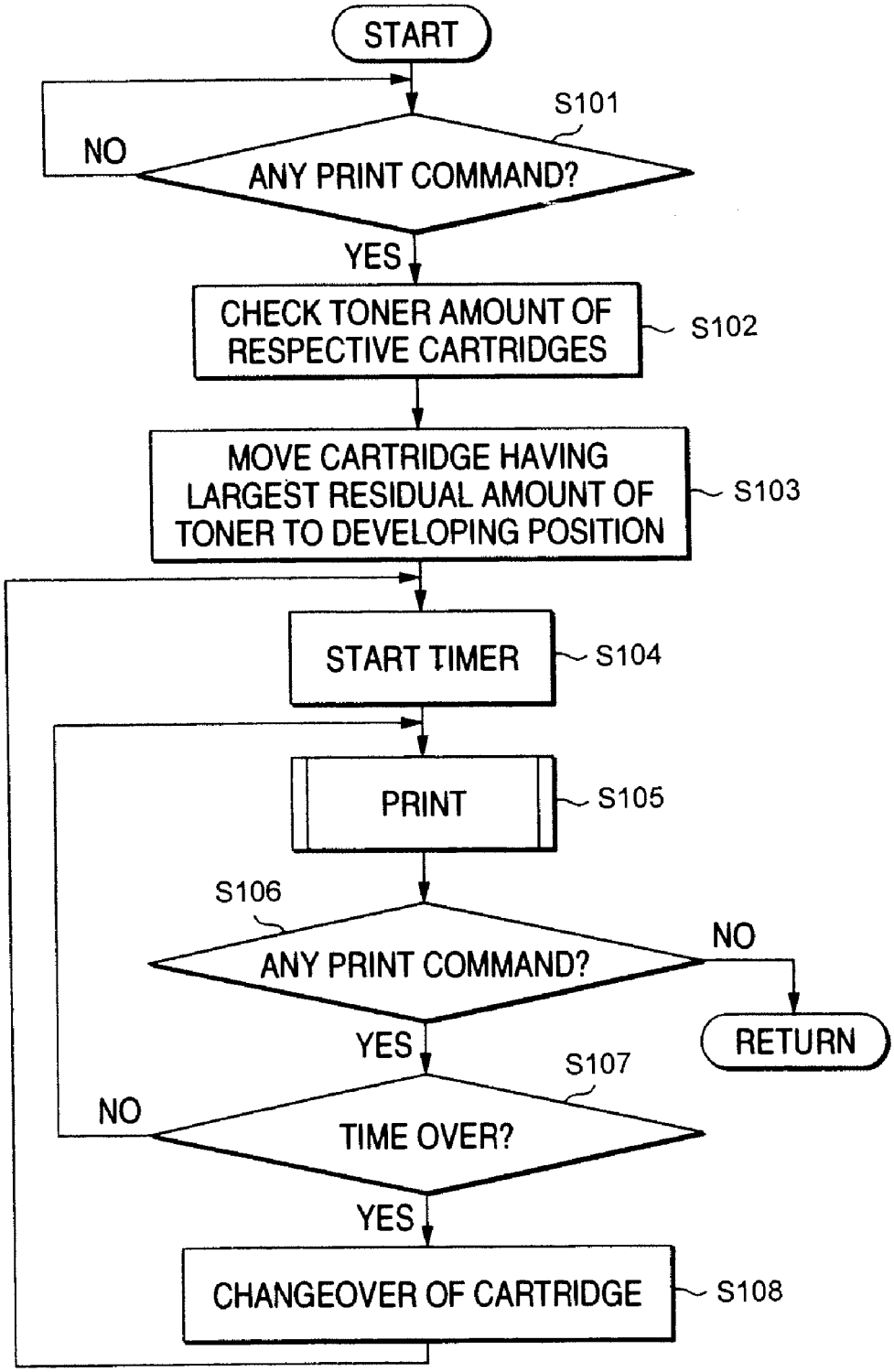
FIG. 20 is a flowchart of an example of a printer to which an image forming apparatus according to a tenth embodiment of the present invention is applied, which illustrates the changeover control of developing cartridges.

Next, FIG. 20 shows changeover control of developing cartridges in a printer being one example of an image forming apparatus according to a tenth embodiment of the present invention. In addition, since the present embodiment is configured substantially similar to the above described embodiment, the same parts are denoted by the same reference numerals and the characterizing portions will be described with reference to the drawings referred to in the above embodiment.

In FIG. 2, the CPU 13 of the engine control part 12 in the present embodiment, as shown in flowcharts in FIG. 16 to FIG. 18, confirms the existence or non-existence of toners in developer cartridges 37 set in the accommodating spaces 41*y*, 41*m*, 41*c* and 41*k* of the developing rotary unit 33 and the color information on the toners. In this case, for example, if the CPU 13 confirms that the four developer cartridges 37 containing a black (K) toner are set to form a monochromatic image continuously (Steps S81 to S88), the CPU 13 executes an image forming control including the changeover of the developer cartridges 37 at a predetermined timing after the processing of an image forming job starts.

For example, the CPU 13 continues performing the image forming operation while changing the developer cartridges 37 whenever the integrated operation time clocked by the built-in timer 13*a* reaches a preset time. It is preferable that the preset time may be set in a rewritable memory, or set in a control program. For example, it is preferable that the preset time is set ½, ⅓ of the development operation, that is shorter than the development operation time which needs replenishing toner into space of the developing roller 37*b* and the supply roller 37*c* by rotating the developing rotary unit 33. Extremely, the processing time for one recording sheet S may be set as the preset time as long as a problem due to image forming processing speed (so-called, throughput) or noise does not occur. Further, the preset changer timing is not limited to the integrated operation time. For example, an integrated number of developed sheets a counted value by a toner counter, a dot number of an image, a measured residual amount of toner, etc. are detected, and whenever the detected values exceeds set values, a developer cartridge to be operated is repeatedly changed over, thereby using the developer cartridges 37 equally.

Specifically, as shown in a flowchart of FIG. 20, the CPU 13 first receives a print command of image data of a monochromatic image from the controller part 12, and changes over the existing developer cartridge to a developer cartridge 37 having the largest residual amount of toner (Steps S101 to S103), similar to the above-described embodiment.

Thereafter, the CPU 13 causes the built-in timer 13*a* to be started and clock an integrated time for which the developing operation (image forming) is performed (Step S104), and executes the drive control of the sheet conveying unit 20 and the image recording unit 30 for printing received data to form an image on one side or both sides of the recording sheet S (Step S105).

Next, the CPU 13 confirms whether or not there is a next print command (an unprocessed print command) (step S106). If there is no unprocessed print command, the CPU 13 stops the image forming control. However, if there is any unprocessed image command, the CPU 13 confirms whether or not the integrated operation time, using the same developer cartridge 37, which is clocked by the timer 13*a*, exceeds a preset time (Step S107). If the integrated operation time does not exceed the preset time, the CPU 13 directly returns to Step S105 to continue printing (developing) of the image data by the same developer cartridge 37, to repeat forming of an image onto the recording sheet S (Steps S105 to S107).

On the other hand, if the integrated operation time, using the same developer cartridge 37, which is clocked by the timer 13*a*, exceeds a preset time, the developing rotary unit 33 is rotated before the developer cartridges 37 reach their usable limits (lifetime), the developer cartridge 37 is changed over so that the adjacent usable next developer cartridge 37 is moved to the developing position facing the photosensitive drum 32 (S108). Thereafter, the CPU 13 returns to Step S104, the developer cartridge 37 are changed over for every set time until any unprocessed print command doest not exist, to repeat a series of image forming operation, and thereby record and form a monochromatic image on one side or both sides of a recording sheet S (Steps S104 to S108).

As a result, the developer cartridges 37 are changed over at a set timing during the processing of an image forming job (for example, for every amount of an image to be formed, etc.), so that the developer cartridges 37 are equally used, the period until any one of the developer cartridges 37 runs out can be lengthened as much as possible, and the existing developer cartridge can be rapidly changed over to the adjacent developer cartridge 37 to replenish toner.

As thus described, the present embodiment can obtain the effects according to the above-described embodiments. In a case in which the developer cartridges 37 containing the same color toners are mounted in the accommodating spaces 41*y*, 41*m*, 41*c* and 41*k* of the developing rotary unit 33 to continuously form a monochromatic image, a developer cartridge 37 having the longest residual amount of toner is preferentially used when the image forming operation starts. In addition to the above, since the developer cartridges 37 are frequently changed over whenever the integrated operation time exceeds a preset time after the image forming operation has started, the same color toners within the developer cartridges 37 can be equally used as much as possible, and the period which can be changed over to the next developer cartridge 37 can be more prolonged.

Accordingly, a situation that it becomes necessary early that the developing rotary unit 33 is continuously rotated to change over the developer cartridges 37 can be avoided, and a monochromatic image can be continuously formed to finish the image forming operation without stress.

Figure 21:
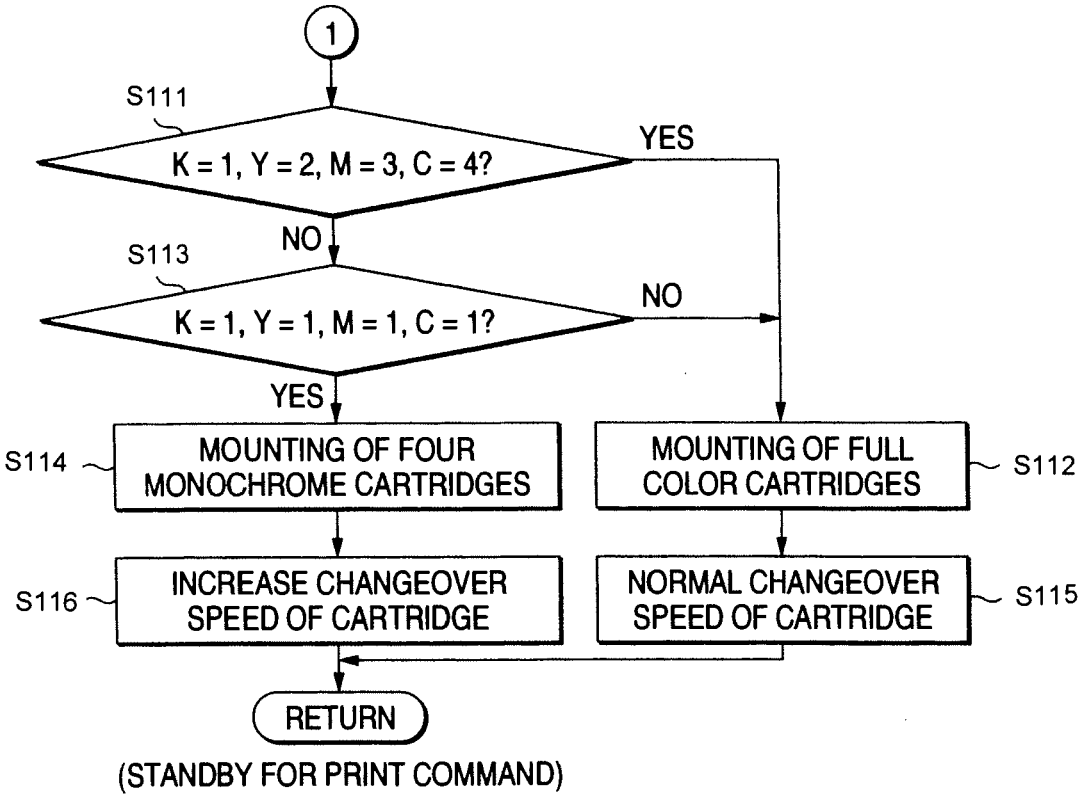
FIG. 21 is a flowchart of an example of a printer to which an image forming apparatus according to an eleventh embodiment of the present invention is applied, which illustrates the changeover control of developing cartridges.
Figure 22:
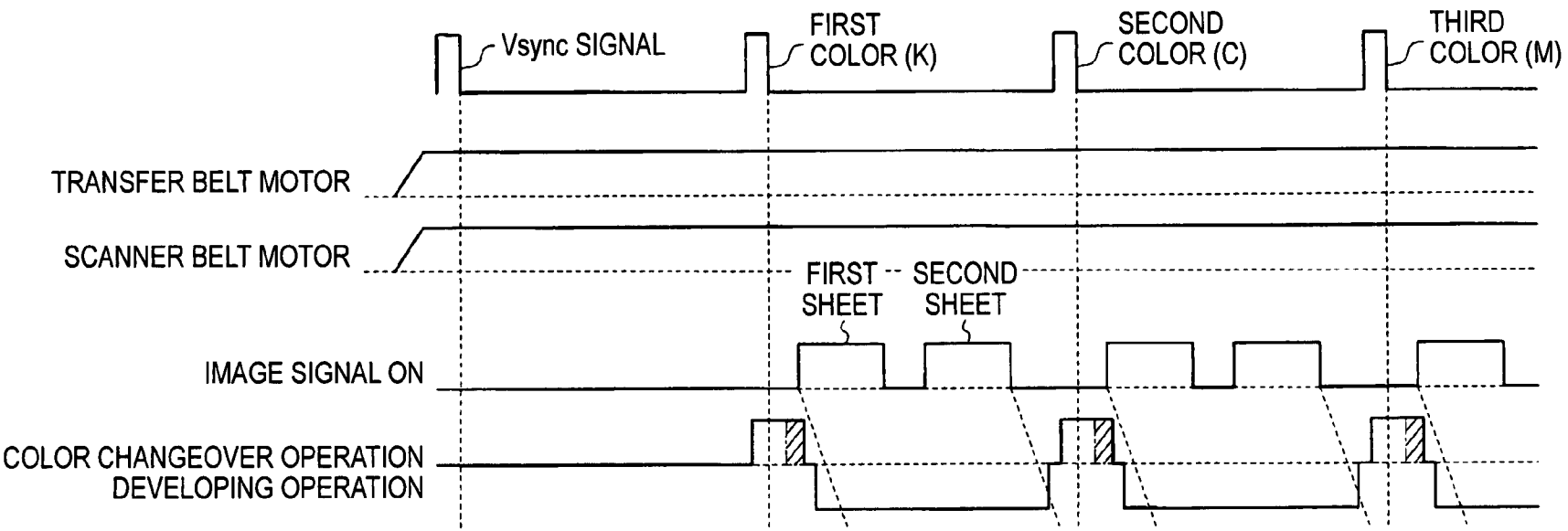
FIG. 22 is a timing chart for explaining the effects of the present invention.

FIG. 21 and FIG. 22 show changeover control of developing cartridges in a printer being one example of an image forming apparatus according to a eleventh embodiment of the present invention. In addition, since the present embodiment is configured substantially similar to the above described embodiment, the same parts are denoted by the same reference numerals and the characterizing portions will be described with reference to the drawings referred to in the above embodiments.

In FIG. 2, the CPU 13 of the engine control part 12 in the present embodiment, as shown in flowcharts in FIG. 16 to FIG. 21, confirms the existence or non-existence of toners in developer cartridges 37 set in the accommodating spaces 41*y*, 41*m*, 41*c* and 41*k* of the developing rotary unit 33 and the color information on the toners. In this case, if the CPU 13 confirms that the developer cartridges 37 containing the respective color toners of the yellow (Y), magenta (M), cyan (C) and black (K) are set to form a full color image (Steps S81 to S86), the CPU 13 selects a general image forming control to set to change over the developer cartridges 37 at normal speed, and executes the image forming operation similar to the above first and second embodiments.

Here, as indicated by the solid line in a timing chart of FIG. 22, the CPU 13 controls the surface of the photosensitive drum 32 to be exposed and scanned by an turned-on image signal based on the image data of the laser light scanning unit 31, on the basis of the a Vsyhc signal which synchronizes with one rotation of the intermediate transfer belt 34, and executes the developing operation of an electrostatic latent image formed on the surface of the photosensitive drum 32, and the changeover operation (color changeover operation of the developer cartridges 37 according to the image data. In addition, FIG. 22 illustrates forming on the intermediate transfer belt 34 a toner image to be transferred onto two recording sheets S.

In this case, it is necessary to form a high-quality image (a toner image) on the intermediate transfer belt 34 by superposing toner images of respective colors on each other without color shift. Specifically, there is a certain limit to the normal changeover speed (the rotational speed of the developing rotary unit 33) of the developer cartridges 37 when a color image is formed because it is necessary to relieve vibration, etc. so as to be able to perform high-precision position control in superposing colors.

However, because it is necessary to superpose toner images on each other when a monochromatic image is formed, the period of time which is taken from the completion of rotation of the developing rotary unit 33 to the start of developing operation of a developer cartridge 37 can be shortened, so that the rotational speed of the developing rotary unit 33, and the changeover speed of the developer cartridges 37 can be increased.

Thus, the CPU 13 confirms the existence or non-existence of toners in developer cartridges 37 set in the accommodating spaces 41*y*, 41*m*, 41*c* and 41*k* of the developing rotary unit 33 and the color information on the toners. For example, if the CPU 13 confirms that the four developer cartridges 37 containing the black toner are set to continuously form a monochromatic image (Steps S81–S84; S111, S113, S114), for example, the CPU 13 can set to increase the rotational speed of the developing rotary unit 33 to increase the changeover speed of the developer cartridges 37 (Step S116), and executes the image forming operation similar to the above ninth and tenth embodiments.

As a result, as indicated by one-dot chain lines in a timing chart of FIG. 22, the period of time which is taken from the completion of rotation of the developing rotary unit 33 to the start of developing operation of a developer cartridge 37 can be sufficiently obtained, and the time enough to allot the processing of other program during the period hatched in the drawing can be secured. Further, since the start time and stopping time of development can be sufficiently obtained, it is needless to say that image forming having excellent position control can be performed.

In addition, although the present embodiment has been described about a case in which the rotational speed of the developing rotary unit 33 is increased, in addition to this case or instead of this, the period of time which is taken from the completion of rotation of the developing rotary unit 33 to the start of developing operation of a developer cartridge 37 may be shortened, or the driving speed (the forming or transfer speed of a toner image) the intermediate transfer belt 34 may be increased to increase the entire image forming speed.

As thus described, the present embodiment can obtain the effects according to the above-described embodiments. Also, in a case in which the developer cartridges 37 containing the same color toner are mounted in the accommodating spaces 41*y*, 41*m*, 41*c* and 41*k* of the developing rotary unit 33 to continuously form a monochromatic image (in the case of a machine for exclusive use which forming a monochromatic image, the image forming operation can be made faster than the color image forming operation. Accordingly, the quality of a monochromatic image can be improved and the forming operation of a monochromatic image can be made faster (so-called throughput can be enhanced).

Here, it is needless to say that the print commands in the above-described embodiments, may be print commands which are received from the personal computer PC for every job which prints one document (a job which prints a plurality of image data sheets at a time), or print commands which are received for every job (a job which is generated for every page) which is generated in units of pages in the one document.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2004-066150 filed on Mar. 9, 2004, Japan Patent Application No. 2004-066151 filed on Mar. 9, 2004, Japan Patent Application No. 2004-066152 filed on Mar. 9, 2004, Japan Patent Application No. 2004-066153 filed on Mar. 9, 2004, the contents of which are incorporated herein for reference.

What is claimed is:

1. An image forming apparatus comprising:

a carrier, on which an electrostatic latent image is formed;

a plurality of development cartridges, which develop the electrostatic latent image with toner to form a toner image to be transferred to a recording sheet; and a changeover unit, which changes the development cartridges so that any one of the development cartridges is moved so as to face the carrier for development, wherein at least two of the development cartridges contain the same color toners, wherein the changeover unit repeatedly changes the development cartridges before an expiration of lifetime of one of the development cartridges which is positioned so as to face the carrier for the development, and wherein the changeover unit changes the development cartridges either before a processing of an image forming job is started or after the processing of the image forming job is finished.

2. An image forming apparatus comprising:

a carrier, on which an electrostatic latent image is formed;

a plurality of development cartridges, which develop the electrostatic latent image with toner to form a toner image to be transferred to a recording sheet; and a changeover unit, which changes the development cartridges so that any one of the development cartridges is moved so as to face the carrier for development, wherein at least two of the development cartridges contain the same color toners, wherein the changeover unit repeatedly changes the development cartridges before an expiration of lifetime of one of the development cartridges which is positioned so as to face the carrier for the development, and wherein when a next image forming command is received after a developing operation based on a previous image forming command is finished, the changeover unit changes one of the development cartridges which has performed the previous image forming operation to another one of the development cartridges to start another developing operation based on the next image forming command.

3. The image forming apparatus as set forth in claim 2, wherein the changeover unit changes the development cartridges when the next image forming command is received at a discontinuity timing between developing operations.

4. The image forming apparatus as set forth in claim 2, wherein the changeover unit changes the development cartridges even when the next image forming command is received while the one of the development cartridges continuously performs developing operations.

5. The image forming apparatus as set forth in claim 2, wherein the changeover unit changes one of the development cartridges which has performed a developing operation based on an image forming command to another one of the development cartridges which performs another developing operation based on a next image forming command which follows the image forming command.

6. The image forming apparatus comprising:

a carrier, on which an electrostatic latent image is formed;

a plurality of development cartridges, which develop the electrostatic latent image with toner to form a toner image to be transferred to a recording sheet;

a changeover unit, which changes the development cartridges so that any one of the development cartridges is moved so as to face the carrier for development; and a clock unit, which clocks a lapsed time from a completion of a previous developing operation for individual developer cartridge, wherein at least two of the development cartridges contain the same color toners;

wherein the changeover unit repeatedly changes the development cartridges before an expiration of lifetime of one of the development cartridges which is positioned so as to face the carrier for the development; and wherein the changeover unit changes the development cartridges in accordance with the lapsed time.

7. The image forming apparatus as set forth in claim 6, wherein the changeover unit changes one of the development cartridges which has the longest clocking time by the clock unit so as to face the carrier for the development.

8. The image forming apparatus as set forth in claim 6, wherein the changeover unit changes one of the development cartridges so as to face the carrier when an image forming operation is started.

9. An image forming apparatus, comprising:

a carrier, on which an electrostatic latent image is formed;

a plurality of development cartridges, which develop the electrostatic latent image with toners to form a toner image to be transferred to a recording sheet;

a rotary unit, having a plurality of accommodation spaces each of which accommodates one of the development cartridges around a rotating shaft of the rotary unit, and rotates about the rotating shaft the development cartridges so as to move any one of the development cartridges to face the carrier for development;

a controller, which controls a rotation of the rotary unit and a driving of the developer cartridges to form the toner image; and a confirming unit, which determines whether every one of the accommodation spaces accommodates one of the development cartridges, wherein the all of the development cartridges contain the same color toners; and wherein the controller starts an image forming operation when the confirming unit determines that every one of the accommodation spaces accommodates one of the development cartridges.

10. The image forming apparatus as set forth in claim 9, further comprising a detecting unit which detects rest of lifetime of the developer cartridges, wherein when a processing of an image forming job is started, the controller changes one of the development cartridges which has the longest rest of lifetime so as to face the carrier in accordance with information from the detecting unit to start the image forming operation.

11. The image forming apparatus as set forth in claim 9, wherein the controller changes a current development cartridge which is positioned to face the carrier to another development cartridge at a preset timing after an image forming job has started.

12. The image forming apparatus as set forth in claim 9, wherein the rotary unit is adapted to mount a development cartridge containing a color toner for forming a color image; and wherein the controller controls the image forming operation so as to be faster than a color image forming operation when the confirming unit determines that the rotary unit accommodates the development cartridges respectively containing the same color toners.

* * * * *